US010808597B2

(12) United States Patent
Furuya et al.

(10) Patent No.: US 10,808,597 B2
(45) Date of Patent: Oct. 20, 2020

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Yoshihiro Furuya, Toyota (JP); Rihito Kaneko, Miyoshi (JP); Noboru Takagi, Toyota (JP); Masaaki Yamaguchi, Okazaki (JP); Hirokazu Ando, Seto (JP); Mitsuru Yamaguchi, Ama (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 172 days.

(21) Appl. No.: 16/124,779

(22) Filed: Sep. 7, 2018

(65) Prior Publication Data

US 2019/0078496 A1 Mar. 14, 2019

(30) Foreign Application Priority Data

Sep. 12, 2017 (JP) ..... 2017-175085

(51) Int. Cl.
*F01P 7/16* (2006.01)
*F01P 5/02* (2006.01)
(Continued)

(52) U.S. Cl.
CPC ..... *F01P 7/16* (2013.01); *F01P 5/02* (2013.01); *F01P 7/165* (2013.01); *F02D 41/062* (2013.01);
(Continued)

(58) Field of Classification Search
CPC ..... F01P 7/16; F01P 7/165; F01P 5/02; F01P 2060/16; F01P 2037/02; F01P 2007/146;
(Continued)

(56) References Cited

U.S. PATENT DOCUMENTS 9,828,932 B2 * 11/2017 Santoso ..... F02D 35/026
2013/0080039 A1 * 3/2013 Nakamoto ..... F02D 41/403 701/113
(Continued)

FOREIGN PATENT DOCUMENTS

CN 103016176 A 4/2013
CN 104033230 A 9/2014
(Continued)

*Primary Examiner* — Joseph J Dallo
*Assistant Examiner* — Kurt Philip Liethen
(74) *Attorney, Agent, or Firm* — Finnegan, Henderson, Farabow, Garrett & Dunner, LLP

(57) ABSTRACT

An internal combustion engine includes a water jacket, a cooling water pump as a cooling liquid pump, and an adjusting valve. A control device for the internal combustion engine executes the water stoppage control of increasing the temperature of the engine body by limiting the discharge of the cooling liquid from the water jacket by the adjusting valve, and an automatic stop and automatic startup control of automatically stopping and automatically starting the internal combustion engine. The control device increases the fuel injection amount for automatically starting the internal combustion engine in a case where the water stoppage control is being executed when the internal combustion engine is automatically stopped as compared with a case where the water stoppage control is not being executed when the internal combustion engine is automatically stopped.

7 Claims, 8 Drawing Sheets

(51) Int. Cl.

| | |
|---|---|
| ***F02D 45/00*** | (2006.01) |
| ***F02D 41/06*** | (2006.01) |
| ***F01P 7/14*** | (2006.01) |
| ***F02N 11/08*** | (2006.01) |

(52) U.S. Cl.
CPC ..... *F02D 45/00* (2013.01); *F01P 2007/146* (2013.01); *F01P 2037/02* (2013.01); *F01P 2060/16* (2013.01); *F02N 11/0814* (2013.01)

(58) Field of Classification Search
CPC .. F01P 3/02; F01P 2003/021; F01P 2003/024; F02D 45/00; F02D 41/062; F02N 11/0814
See application file for complete search history.

(56) References Cited

U.S. PATENT DOCUMENTS

| | | | | |
|---|---|---|---|---|
| 2014/0257676 | A1 | 9/2014 | Santoso et al. | |
| 2015/0142297 | A1* | 5/2015 | Kojima | F02D 41/3076 701/104 |
| 2015/0183435 | A1* | 7/2015 | Johnson | F02N 19/10 701/112 |
| 2015/0330351 | A1* | 11/2015 | Ragazzi | F02N 19/10 123/552 |
| 2016/0376977 | A1 | 12/2016 | Watanabe | |
| 2017/0198628 | A1* | 7/2017 | Spiess | F01P 7/167 |
| 2017/0292435 | A1* | 10/2017 | Toyama | F01P 7/164 |

FOREIGN PATENT DOCUMENTS

| | | |
|---|---|---|
| JP | 2013-253582 | 12/2013 |
| JP | 2014-181648 | 9/2014 |
| JP | 2017-008824 | 1/2017 |

* cited by examiner

Water Stoppage Cooling Water Temperature

| Water Stoppage Elapsed Time | | | High c1 | ... | ck | ... | Low cn | |
|---|---|---|---|---|---|---|---|---|
| Short | t1 | Small | Q111 | | ... | | Q11n | R1 Medium |
| | ⋮ | | ⋮ | | | | | |
| | tk | | Q1k1 | | Q1kk | | ⋮ | R2 |
| | ⋮ | | ⋮ | | | | | |
| | tl | | Q1l1 | | | | | |
| | ⋮ | | ⋮ | | | | | |
| | tm | | Q1m1 | | | | ⋮ | R3 |
| | ⋮ | | ⋮ | | | | | |
| Long | tn | Medium | Q1n1 | | ... | | Q1nn | Large |

Water Flow Cooling Water Temperature

| Water Flow Elapsed Time | | | High c1 | ... | ck | ... | Low cn | |
|---|---|---|---|---|---|---|---|---|
| Short | t1 | Small | Q211 | | ... | | Q21n | R1 Medium |
| | ⋮ | | ⋮ | | | | | |
| | tk | | Q2k1 | | Q2kk | | ⋮ | R2 |
| | ⋮ | | ⋮ | | | | | |
| | tl | | Q2l1 | | | | | |
| | ⋮ | | ⋮ | | | | | |
| | tm | | Q2m1 | | | | ⋮ | R3 |
| | ⋮ | | ⋮ | | | | | |
| Long | tn | Medium | Q2n1 | | ... | | Q2nn | Large |

Cooling Water Temperature

Bore Wall Temperature

Operating Amount of Brake Pedal
First Predetermined Amount
Second Predetermined Amount Vehicle Speed
Predetermined Speed Engine Rotational Speed
0

Automatic Stop Condition
Satisfied
Not Satisfied

Automatic Startup Condition
Not Satisfied
Satisfied

Startup Fuel Injection Amount
t100
t101
t102

CONTROL DEVICE FOR INTERNAL COMBUSTION ENGINE

BACKGROUND

The present disclosure relates to a control device for an internal combustion engine.

An internal combustion engine disclosed in Japanese Laid-Open Patent Publication No. 2017-8824 is provided with a cooling water passage, through which cooling water flows. The cooling water passage has a water jacket, which cools the main body of the internal combustion engine. The inlet of the water jacket is connected to an introduction passage. A water pump is disposed in the introduction passage. The water pump supplies cooling water from the introduction passage to the water jacket. The outlet of the water jacket is connected to a discharging passage for discharging the cooling water from the water jacket. An adjusting valve is connected to the discharging passage. The adjusting valve has one inflow port connected to the discharging passage and three discharge ports for discharging the cooling water. One of the three discharge ports is connected to a first circulation flow path, through which the cooling water flows via the radiator. Another discharge port is connected to a second circulation flow path, through which the cooling water flows via a device such as an oil cooler. The other discharge port is connected to a third circulation flow path, through which the cooling water flows via a heater of an air conditioner of a vehicle. The first to third circulation flow paths are connected to the introduction passage. As a result, the cooling water circulates through the cooling water passage. The adjusting valve is configured to be capable of controlling the temperature of the cooling water by adjusting the amount of cooling water flowing from each discharge port to each circulation flow path. Further, the adjusting valve is configured to be capable of stopping the discharge of the cooling water from each discharge port.

The control device for an internal combustion engine described in this document executes automatic stop and automatic startup control for automatically stopping the internal combustion engine when the automatic stop condition is satisfied and for automatically starting the internal combustion engine when the automatic startup condition is satisfied. When the internal combustion engine is automatically stopped, the control device maintains the adjusting valve in a state immediately before the internal combustion engine is automatically stopped. Further, the control device executes a water stoppage control of controlling the adjusting valve to stop the discharge of the cooling water from each discharge port when the internal combustion engine warms up.

The fuel injection amount of the internal combustion engine is calculated in consideration of the cooling water temperature near the outlet of the water jacket. The cooling water temperature correlates with a wall temperature of the combustion chamber (hereinafter referred to as the bore wall temperature). Therefore, by detecting the cooling water temperature, it is possible to calculate the fuel injection amount corresponding to the bore wall temperature estimated from the cooling water temperature. Even when the internal combustion engine is automatically started by the automatic stop and automatic startup control, the fuel injection amount can be set based on the cooling water temperature. In this case, it is desirable to set an adaptation value of the fuel injection amount based on the cooling water temperature in consideration of the degree of decrease in the bore wall temperature and the like from the automatic stop to the automatic startup of the internal combustion engine.

When the water stoppage control is not being executed, the cooling water flows in the water jacket during operation of the internal combustion engine. For this reason, the cooling water temperature in the water jacket is kept substantially uniform. Therefore, even if the internal combustion engine is stopped, the cooling water temperature detected near the outlet of the water jacket reflects the bore wall temperature.

When the water stoppage control is being executed, the flow of the cooling water in the water jacket is stopped even while the internal combustion engine is in operation. In this case, in the water jacket, since the temperature around the bore near the heat source locally increases, the distribution of the cooling water temperature becomes uneven. When the internal combustion engine continues to be stopped in this state, heat is not transmitted from the heat source to the cooling water. For this reason, heat is diffused from high-temperature cooling water around the bore to low-temperature cooling water or the like around the bore. In the process of making the cooling water temperature uniform, the cooling water temperature around the bore may be significantly lower than the cooling water temperature just before stoppage of the internal combustion engine. Along with this, the degree of decrease in the bore wall temperature may become large. In this case, the cooling water temperature detected near the outlet of the water jacket is hard to reflect the bore wall temperature. For this reason, the difference between the cooling water temperature detected when the water stoppage control is being executed and the actual bore wall temperature becomes larger than the difference between the cooling water temperature detected when the water stoppage control is not being executed and the actual bore wall temperature. In other words, the relationship between the cooling water temperature calculated for automatically starting the internal combustion engine and the bore wall temperature estimated from the cooling water temperature may be different between the time when the water stoppage control is being executed and the time when the water stoppage control is not being executed. In other words, in some cases, the cooling water temperature detected for calculating the startup fuel injection amount for performing the automatic startup when the water stoppage control is being executed may be the same as the cooling water temperature detected for calculating the startup fuel injection amount when the water stoppage control is not being executed. Even in such a case, the bore wall temperature when the water stoppage control is being executed may become lower than the bore wall temperature when the water stoppage control is not being executed. As a result, even if the startup fuel injection amount based on the relationship between the cooling water temperature and the bore wall temperature when the water stoppage control is not being executed is applied to a case where the water stoppage control is being executed, the fuel injection amount does not necessarily become a fuel injection amount suitable for performing the automatic startup. Therefore, it is sometimes not possible to sufficiently obtain the control precision of the automatic startup.

SUMMARY

To achieve the foregoing objective and in accordance with a first aspect of the present disclosure, a control device for an internal combustion engine is provided. The internal combustion engine includes an engine body, a water jacket provided in the engine body and constituting a passage of cooling liquid for cooling the engine body, a cooling liquid pump, which supplies the cooling liquid to the water jacket, and an adjusting valve, which adjusts a flow rate of the cooling liquid discharged from the water jacket. The control device is configured to execute: a water stoppage control for increasing a temperature of the engine body by limiting discharge of the cooling liquid from the water jacket by the adjusting valve; an automatic stop and automatic startup control for automatically stopping the internal combustion engine when an automatic stop condition is satisfied, and for automatically starting the internal combustion engine when an automatic startup condition is satisfied; and a control for increasing a fuel injection amount for automatically starting the internal combustion engine in a case where the water stoppage control is being executed when the internal combustion engine is automatically stopped as compared with a case where the water stoppage control is not being executed when the internal combustion engine is automatically stopped.

To achieve the foregoing objective and in accordance with a second aspect of the present disclosure, a control device for an internal combustion engine is provided. The internal combustion engine includes an engine body, a water jacket provided in the engine body and constituting a passage of cooling liquid for cooling the engine body, a cooling liquid pump, which supplies the cooling liquid to the water jacket, and an adjusting valve, which adjusts a flow rate of the cooling liquid discharged from the water jacket. The control device includes circuitry configured to execute: a water stoppage control for increasing a temperature of the engine body by limiting discharge of the cooling liquid from the water jacket by the adjusting valve; an automatic stop and automatic startup control for automatically stopping the internal combustion engine when an automatic stop condition is satisfied, and for automatically starting the internal combustion engine when an automatic startup condition is satisfied; and a control for increasing a fuel injection amount for automatically starting the internal combustion engine in a case where the water stoppage control is being executed when the internal combustion engine is automatically stopped as compared with a case where the water stoppage control is not being executed when the internal combustion engine is automatically stopped.

To achieve the foregoing objective and in accordance with a third aspect of the present disclosure, method for controlling an internal combustion engine is provided. The internal combustion engine including an engine body, a water jacket provided in the engine body and constituting a passage of cooling liquid for cooling the engine body, a cooling liquid pump, which supplies the cooling liquid to the water jacket, and an adjusting valve, which adjusts a flow rate of the cooling liquid discharged from the water jacket. The control method includes: increasing a temperature of the engine body by limiting discharge of the cooling liquid from the water jacket by the adjusting valve; automatically stopping the internal combustion engine when an automatic stop condition is satisfied, and automatically starting the internal combustion engine when an automatic startup condition is satisfied; and increasing a fuel injection amount for automatically starting the internal combustion engine in a case where the water stoppage control is being executed when the internal combustion engine is automatically stopped as compared with a case where the water stoppage control is not being executed when the internal combustion engine is automatically stopped.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A control device for an internal combustion engine according to a first embodiment will be described with reference to FIGS. 1 to 11H. The internal combustion engine and the control device for the internal combustion engine are mounted on a vehicle.

Figure 1:
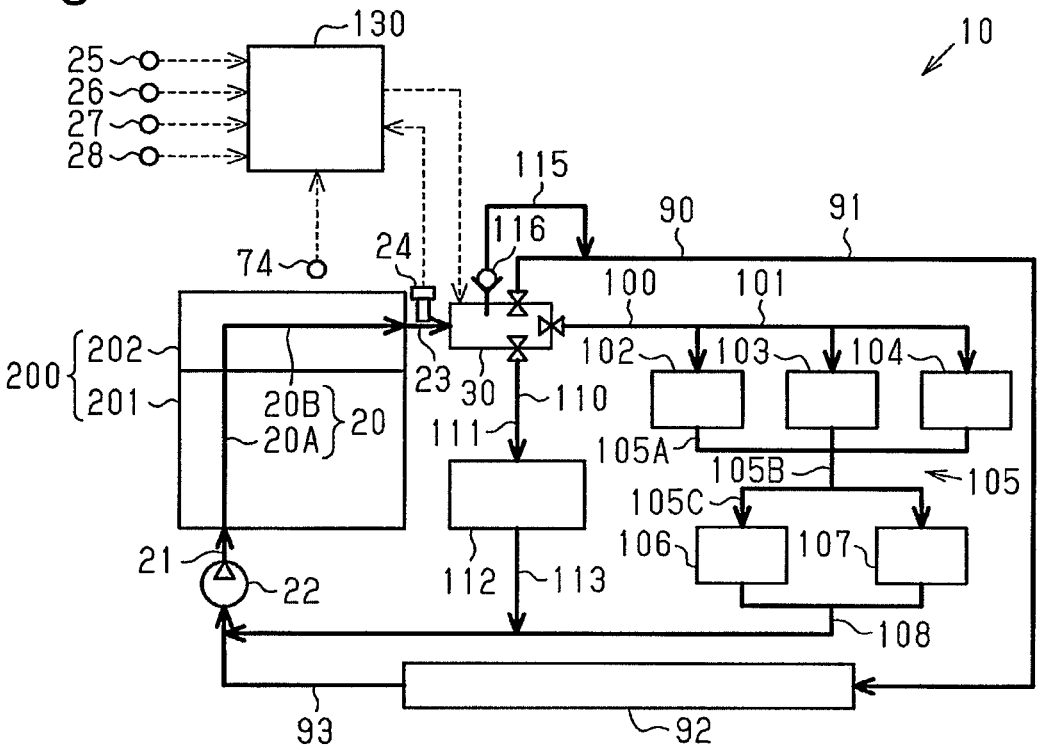
FIG. 1 is a schematic diagram illustrating a schematic configuration of a control device for an internal combustion engine according to a first embodiment of the present disclosure.

As illustrated in FIG. 1, the internal combustion engine is equipped with an engine body 200 including a cylinder block 201 and a cylinder head 202 connected to the upper end of the cylinder block 201. The vehicle is provided with a cooling water passage 10, through which cooling water as a cooling liquid flows in the internal combustion engine. A water jacket 20 is provided inside the engine body 200. The cooling water passage 10 has a water jacket 20. The water jacket 20 includes a block-side water jacket 20A provided in the cylinder block 201 and a head-side water jacket 20B provided in the cylinder head 202 and communicating with the block-side water jacket 20A. A part of the block-side water jacket 20A is provided around a combustion chamber (not illustrated) in the engine body 200. A fuel injection valve (not illustrated) is provided in the combustion chamber.

The inlet of the water jacket 20 opens in the cylinder block 201. The opening is connected to one end of an introduction pipe 21. The other end of the introduction pipe 21 is connected to a cooling water pump 22. The cooling water pump 22 is an engine-driven pump, which is driven by the crankshaft of the internal combustion engine. As the cooling water pump 22 is driven along with the rotation of the crankshaft, the cooling water is supplied from the cooling water pump 22 to the water jacket 20 through the introduction pipe 21.

The outlet of the water jacket 20 opens in the cylinder head 202. The opening is connected to one end of a discharging pipe 23. The other end of the discharging pipe 23 is connected to an adjusting valve 30. The discharging pipe 23 is provided with a water temperature sensor 24, which detects the temperature of the cooling water flowing through the discharging pipe 23.

Three discharge ports of the cooling water are provided in the adjusting valve 30. One of the three discharge ports is connected to a first cooling water passage 90, through which the cooling water flows via a radiator 92. The first cooling water passage 90 includes a first radiator pipe 91, the radiator 92, and a second radiator pipe 93. One end of the first radiator pipe 91 is connected to the discharge port, and the other end of the first radiator pipe 91 is connected to the radiator 92. The second radiator pipe 93 connects the radiator 92 to the cooling water pump 22.

One of the three discharge ports of the adjusting valve 30 is connected to a second cooling water passage 100, through which the cooling water flows via devices provided in each part of the internal combustion engine, such as a throttle body 102 and an EGR valve 103. The second cooling water passage 100 has a first device pipe 101. The end portion on the upstream side of the first device pipe 101 is connected to the discharge port. The end portion on the downstream side of the first device pipe 101 branches into three parts. The three branched end portions are connected to the throttle body 102, the EGR valve 103, and an EGR cooler 104, respectively. The second cooling water passage 100 has a second device pipe 105. The second device pipe 105 includes an upstream branch portion 105A, a merging portion 105B connected to the upstream branch portion 105A, and a downstream branch portion 105C connected to the merging portion 105B. The end portion of the upstream side of the upstream branch portion 105A branches into three parts. Three branched end portions are connected to the throttle body 102, the EGR valve 103, and the EGR cooler 104, respectively. The merging portion 105B constitutes one passage. The end portion on the downstream side of the downstream branch portion 105C branches into two parts. The branched end portions are connected to an oil cooler 106 and an ATF warmer 107, respectively.

The second cooling water passage 100 has a third device pipe 108. The end portion on the upstream side of the third device pipe 108 branches into two parts. Two branched end portions are connected to the oil cooler 106 and the ATF warmer 107, respectively. The end portion on the downstream side of the third device pipe 108 is connected to the second radiator pipe 93. In the second cooling water passage 100, the cooling water flowing from the adjusting valve 30 to the first device pipe 101 flow to branch into the throttle body 102, the EGR valve 103, and the EGR cooler 104. The cooling water having passed through one of the throttle body 102, the EGR valve 103, and the EGR cooler 104 once joins in the second device pipe 105, and then flows to branch into the oil cooler 106 and the ATF warmer 107. The cooling water having passed through one of the oil cooler 106 and the ATF warmer 107 joins in the third device pipe 108 and flows to the cooling water pump 22 through the second radiator pipe 93.

One of the three discharge ports of the adjusting valve 30 is connected to a third cooling water passage 110 for circulating the cooling water to the heater core 112 of the air conditioner of the vehicle. The third cooling water passage 110 includes a first heater pipe 111, a heater core 112, and a second heater pipe 113. One end of the first heater pipe 111 is connected to the discharge port, and the other end of the first heater pipe 111 is connected to the heater core 112. One end of the second heater pipe 113 is connected to the heater core 112, and the other end of the second heater pipe 113 is connected to the third device pipe 108. After passing through the heater core 112, the cooling water flowing through the first heater pipe 111 flows to the third device pipe 108 through the second heater pipe 113. The cooling water flowing through the third device pipe 108 flows to the cooling water pump 22 through the second radiator pipe 93. In this way, the cooling water flowing from the adjusting valve 30 to the respective cooling water passages 90, 100, and 110 joins before the cooling water pump 22, and is supplied to the water jacket 20 again by the cooling water pump 22.

The adjusting valve 30 is provided with a relief passage 115. The relief passage 115 allows the inside of the adjusting valve 30 to communicate with the first cooling water passage 90. A relief valve 116 is provided in the relief passage 115. The relief valve 116 opens when the difference between the pressure of the relief passage 115 on the side of the adjusting valve 30 and the pressure on the side of the first radiator pipe 91 becomes equal to or higher than a predetermined pressure, thereby allowing the cooling water to flow from the adjusting valve 30 to the first cooling water passage 90. As a result, excessive increase in pressure inside the adjusting valve 30 is suppressed.

The structure of the adjusting valve 30 will be described with reference to FIGS. 2 to 5.

Figure 2:
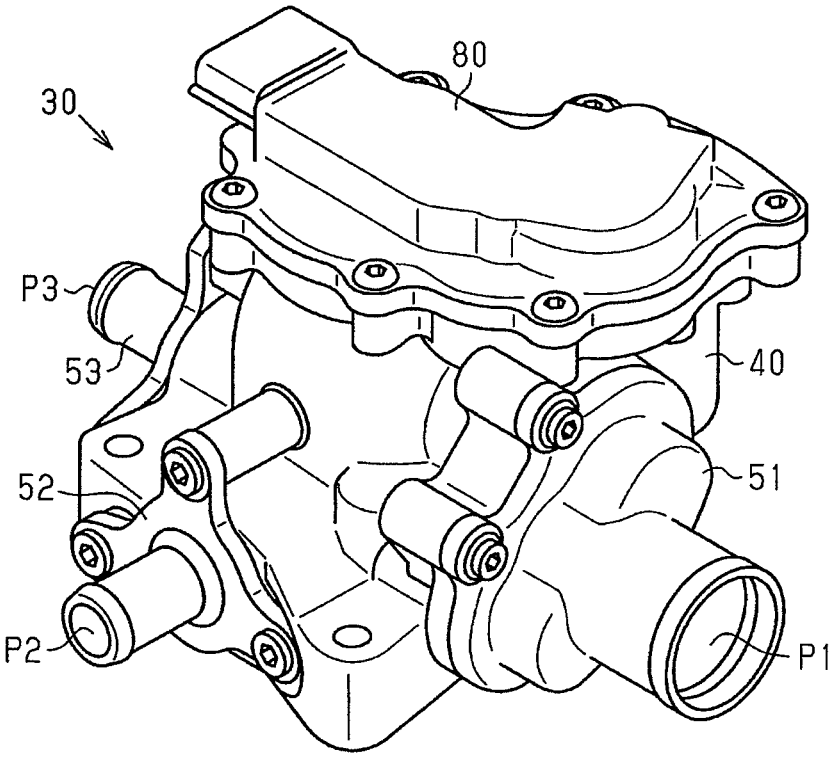
FIG. 2 is a perspective view of an adjusting valve.

As illustrated in FIG. 2, the adjusting valve 30 has three ports, which are discharge ports of the cooling water. The adjusting valve 30 has a radiator port P1, to which the first cooling water passage 90 is connected, a device port P2, to which the second cooling water passage 100 is connected, and a heater port P3, to which the third cooling water passage 110 is connected. The openings of the ports P1, P2, and P3 are oriented in different directions. The inner diameter of the device port P2 is the same as the inner diameter of the heater port P3. The inner diameter of the radiator port P1 is larger than the inner diameters of the device port P2 and the heater port P3.

Figure 3:
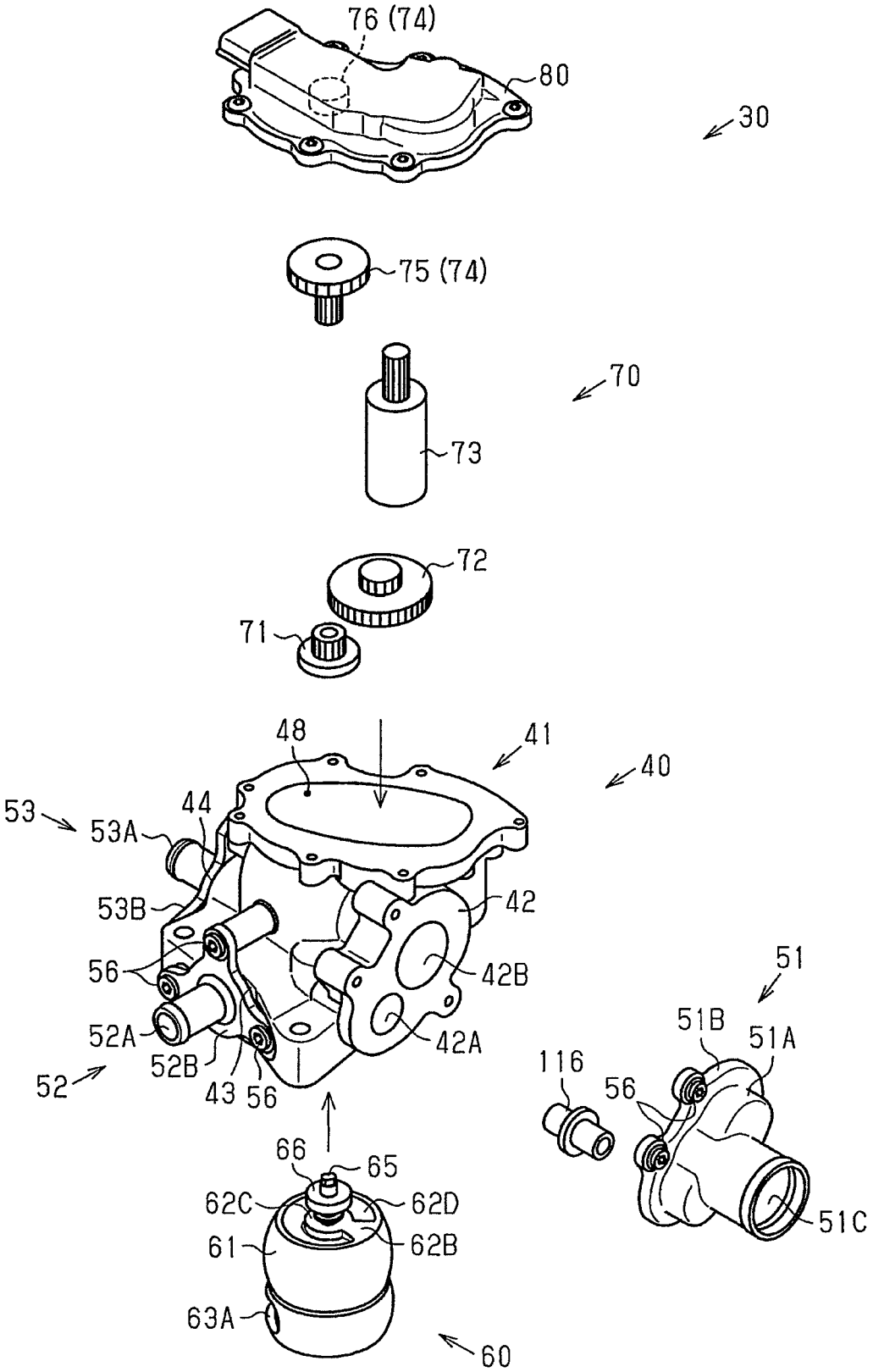
FIG. 3 is an exploded perspective view of the adjusting valve.

As illustrated in FIG. 3, the adjusting valve 30 includes a housing 40, a rotor 60, a pivoting mechanism 70, and a cover 80. The housing 40 has a hollow shape and constitutes the framework of the adjusting valve 30. The housing 40 includes a main body portion 41, a first connector portion 51, a second connector portion 52, and a third connector portion 53. The first connector portion 51, the second connector portion 52, and the third connector portion 53 are attached to the main body portion 41. The first connector portion 51 includes a first bulging portion 51A, a first flange portion 51B, and a first port portion 51C. The first bulging portion 51A has tubular shape with a closed end. The first flange portion 51B has a plate shape and is connected to the opening peripheral edge of the first bulging portion 51A. The first port portion 51C has a cylindrical shape and is connected to the bottom wall of the first bulging portion 51A. The first connector portion 51 is a component of the radiator port P1. The second connector portion 52 includes a second port portion 52A and a second flange portion 52B. The second port portion 52A has a cylindrical shape. The second flange portion 52B has a plate shape and is connected to the opening peripheral edge at one end portion of the second port portion 52A. The second connector portion 52 is a component of the device port P2. The third connector portion 53 includes a third port portion 53A and a third flange portion 53B. The third port portion 53A has a cylindrical shape. The third flange portion 53B has a plate shape and is connected to the opening peripheral edge at one end portion of the third port portion 53A. The third connector portion 53 is a component of the heater port P3. The main body portion 41 has a first attachment portion 42, to which the first connector portion 51 is attached, a second attachment portion 43, to which the second connector portion 52 is attached, and a third attachment portion 44, to which the third connector portion 53 is attached. The first connector portion 51 is attached to the first attachment portion 42 by bolts 56. The second connector portion 52 is attached to the second attachment portion 43 by bolts 56. The third connector portion 53 is attached to the third attachment portion 44 by bolts (not illustrated).

Two holes having different opening areas are provided in the first attachment portion 42. A relief valve 116 is assembled to a first hole 42A having a small opening area among these holes. In the state in which the relief valve 116 is assembled to the first hole 42A, the first connector portion 51 is attached to the first attachment portion 42. Thus, the relief valve 116 is accommodated inside the housing 40. Among the two holes provided in the first attachment portion 42, the first hole 42A constitutes a part of the relief passage 115. Further, a second hole 42B having an opening area larger than that of the first hole 42A constitutes a part of the radiator port P1. The passage sectional area of the radiator port P1 is larger than the passage sectional areas of each of the heater port P3 and the device port P2. In the adjusting valve 30, a sufficient amount of relief is ensured by providing the relief valve 116 in the radiator port P1.

Figure 4:
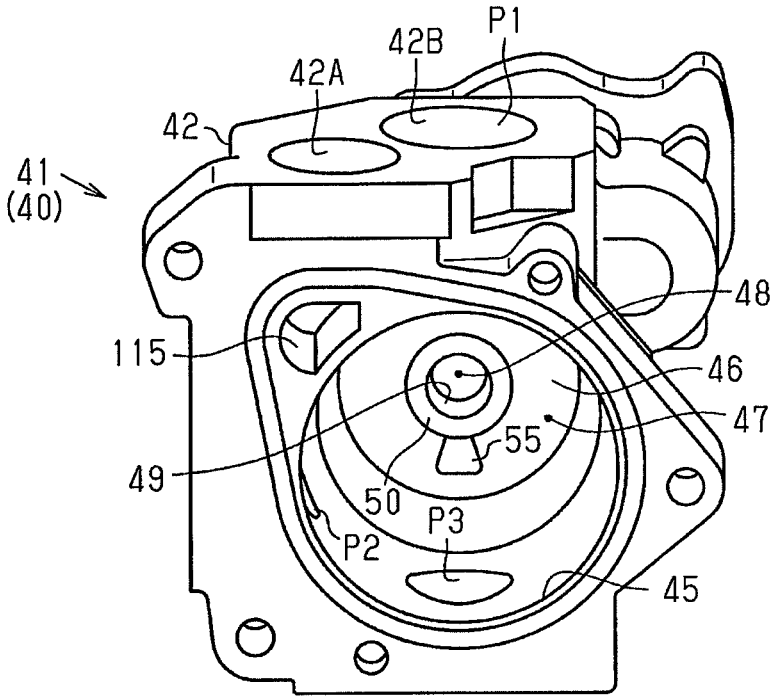
FIG. 4 is a perspective view of a housing of the adjusting valve as viewed from below.

As illustrated in FIG. 4, an opening 45 is provided at the lower end portion of the main body portion 41. The main body portion 41 is provided with a partition wall 46 that partitions the inside thereof vertically. The lower space in the main body portion 41 partitioned by the partition wall 46 is referred to as an inflow space 47. The upper space of the main body portion 41 partitioned by the partition wall 46 is referred to as an accommodation space 48. The radiator port P1, the device port P2, and the heater port P3 are in communication with the inflow space 47. A support hole 49, through which the inflow space 47 and the accommodation space 48 communicate with each other, is provided in the partition wall 46. A sliding contact part 50 protrudes in a cylindrical shape from the opening edge portion of the support hole 49 to the inflow space 47. A stopper 55 protruding outward in the radial direction is connected to the outer side surface of the sliding contact part 50.

As illustrated in FIG. 3, the rotor 60 is assembled to the inside of the main body portion 41 from the lower end portion of the main body portion 41, and the pivoting mechanism 70 is assembled to the inside of the main body portion 41 from the upper end portion of the main body portion 41.

Figure 5:
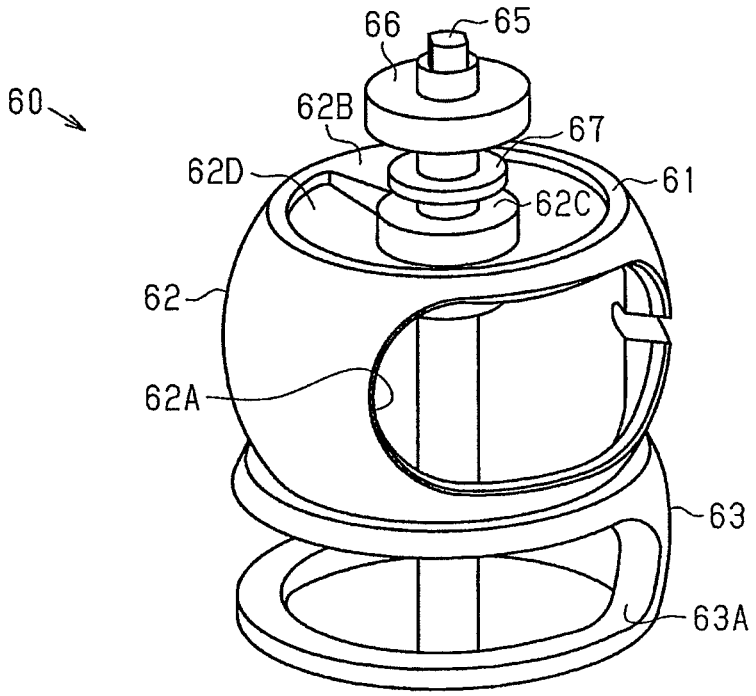
FIG. 5 is a perspective view of a rotor.

As illustrated in FIG. 5, the rotor 60 has a valve member 61 and a rotor shaft 65 inserted through the valve member 61. The valve member 61 has a first valve part 62 arranged on the upper side and a second valve part 63 arranged on the lower side. The first valve part 62 has a cylindrical shape, in which the diameter of the central portion of the rotor shaft 65 in the direction of the central axis (the vertical direction in FIG. 5) is increased. On the side wall of the first valve part 62, a first through hole 62A extending in the circumferential direction is provided. The inner region and the outer region of the first valve part 62 communicate with each other through the first through hole 62A. A protruding wall 62B protrudes radially inward from the upper end of the first valve part 62. A support wall 62C having an annular shape is provided at the tip of the protruding wall 62B. An engaging hole 62D extending in an arc shape in the circumferential direction is provided at the upper end portion of the first valve part 62.

The second valve part 63 has a cylindrical shape. The inner region of the second valve part 63 communicates with the inner region of the first valve part 62. A second through hole 63A is provided on the side wall of the second valve part 63. The circumferential length of the second through hole 63A is larger than the circumferential length of the first through hole 62A.

The rotor shaft 65 has a columnar rod shape. The rotor shaft 65 is inserted and connected to the support wall 62C of the first valve part 62. The rotor shaft 65 passes through the valve member 61 in the vertical direction. A bearing 66 is connected to the upper end portion of the rotor shaft 65. A seal 67 is provided in a portion of the rotor shaft 65 between the bearing 66 and the support wall 62C. The seal 67 has a disc shape. When the rotor shaft 65 rotates, the valve member 61 rotates around the rotor shaft 65 as the rotation center. The rotor 60 is assembled to the housing 40 as follows. First, the upper end portion of the rotor shaft 65, to which the bearing 66 is not connected, is inserted into the support hole 49 of the partition wall 46 of the housing 40 to protrude into the accommodation space 48. The rotor 60 is assembled to the housing 40, by connecting the bearing 66 to the upper end portion of the rotor shaft 65 protruding into the accommodation space 48. In this state, the valve member 61 and the seal 67 are disposed in the inflow space 47, and the bearing 66 is disposed in the accommodation space 48. The bearing 66 is connected to the upper surface of the partition wall 46. Therefore, the rotor shaft 65 and the valve member 61 can be rotationally supported with respect to the housing 40. The seal 67 is brought into contact with the lower surface of the sliding contact part 50. Therefore, as the rotor shaft 65 rotates, the seal 67 makes slide contact with the lower surface of the sliding contact part 50.

In a state in which the rotor 60 is accommodated in the housing 40, the stopper 55 is disposed in the engaging hole 62D of the valve member 61. When the rotor 60 rotates with respect to the housing 40, the stopper 55 moves in the engaging hole 62D in the circumferential direction of the rotor 60. When the stopper 55 abuts against the protruding wall 62B, the rotation of the rotor 60 with respect to the housing 40 is restricted. In this manner, the valve member 61 of the rotor 60 can rotate with respect to the housing 40 within a predetermined range until the stopper 55 abuts against the protruding wall 62B.

When the rotational phase (hereinafter referred to as the rotor phase θ) of the rotor 60 relative to the housing 40 is within a certain range, the first through hole 62A of the rotor 60 communicates with the radiator port P1. When the rotor phase θ is not within this range, the valve member 61 of the rotor 60 closes the radiator port P1. Further, when the rotor phase θ is within another certain range, the second through hole 63A of the rotor 60 communicates with at least one of the device port P2 and the heater port P3.

The discharging pipe 23 is connected to the lower end portion of the housing 40 of the adjusting valve 30. As a result, the cooling water flowing through the water jacket 20 flows into the inflow space 47 through the discharging pipe 23. The cooling water supplied to the inflow space 47 from the discharging pipe 23 flows to the inner region of the rotor 60. When the first through hole 62A and the radiator port P1 communicate with each other, the cooling water flows from the inflow space 47 to the radiator port P1. When the second through hole 63A communicates with the device port P2, the cooling water flows from the inflow space 47 to the device port P2. When the second through hole 63A communicates with the heater port P3, the cooling water flows from the inflow space 47 to the heater port P3. The flow rate of the cooling water flowing through each of the ports P1, P2 and P3 can be adjusted by rotating the rotor 60 to change the cross-sectional areas of the flow paths of the respective ports P1, P2, and P3. A seal 67 makes slide contact with the lower surface of the sliding contact part 50, thereby restricting the flow of the cooling water from the inflow space 47 to the accommodation space 48.

As illustrated in FIG. 3, the pivoting mechanism 70 has a first gear 71 connected to the upper end of the rotor shaft 65 and a second gear 72 meshing with the first gear 71. A motor 73 is connected to the second gear 72. As the motor 73 rotates the second gear 72, the second gear 72 rotates the rotor 60 via the first gear 71. A phase sensor 74 for detecting the driving amount of the motor 73, that is, the rotor phase θ is attached to the motor 73. The phase sensor 74 includes a detection gear 75 rotationally driven by the motor 73, and a sensor part 76, which detects the rotation phase of the detection gear 75. The sensor part 76 is attached to the cover 80. The pivoting mechanism 70 is disposed in the accommodation space 48 of the housing 40. The cover 80 is attached to the housing 40 so as to close the upper end opening of the main body portion 41. As a result, the pivoting mechanism 70 is accommodated inside the housing 40.

Next, the relationship between the rotor phase θ of the adjusting valve 30 and the aperture ratios of the ports P1, P2, and P3 will be described.

Figure 6:
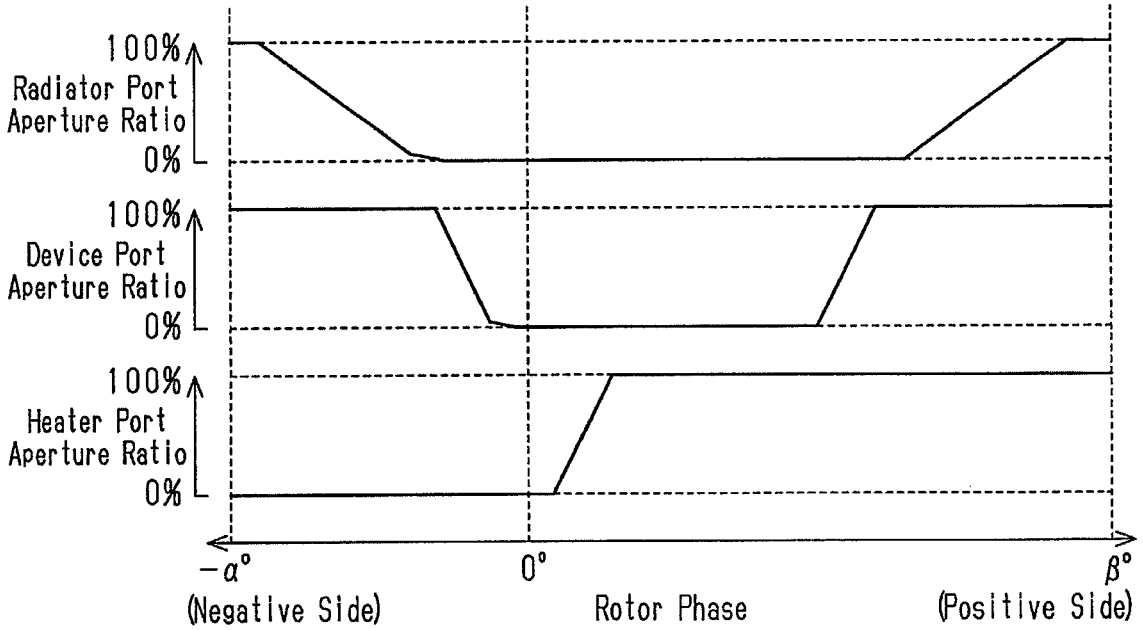
FIG. 6 is a graph illustrating a relationship between a rotor phase and an aperture ratio of each port.

As illustrated in FIG. 6, in the adjusting valve 30, the rotor phase θ when all the ports P1, P2, and P3 are in a closed state is defined as 0°. In this state, the rotor 60 can be rotated in the clockwise direction (the positive direction) and the counterclockwise direction (a negative direction) when the valve member 61 is viewed from above. In the aperture ratio of each of the ports P1, P2, and P3, the opening area is expressed by 100% at the time of fully opening each port, and the opening area is expressed by 0% at the time of fully closing each port.

The aperture ratio of each of the ports P1, P2, and P3 varies depending on the rotor phase θ. When the rotor 60 is rotated in the positive direction from the position at which the rotor phase θ is 0°, the heater port P3 starts to open. Further, the aperture ratio of the heater port P3 increases as the rotor phase θ increases in the positive direction. After the aperture ratio of the heater port P3 reaches 100% and it is fully opened, when the rotor phase θ is further increased, the device port P2 starts to open. Further, with an increase in the rotor phase θ in the positive direction, the aperture ratio of the device port P2 increases. After the aperture ratio of the device port P2 has reached 100% and it is fully opened, when the rotor phase θ is further increased, the radiator port P1 starts to open. Then, the aperture ratio of the radiator port P1 increases as the rotor phase θ increases in the positive direction. Assuming that the rotor phase θ at which the protruding wall 62B and the stopper 55 abut against each other is defined as β°, the radiator port P1 is fully opened before the rotor phase θ reaches β°. Until the rotor phase θ reaches β° from this state, each of the ports P1, P2 and P3 is fully opened. In this way, in the adjusting valve 30, the end of the movable range of the rotor 60 and the motor 73 in the positive direction is a position at which the rotor phase θ is β°. In this phase, all the ports P1, P2, and P3 are fully opened.

In contrast, when the rotor 60 is rotated in the negative direction from the position at which the rotor phase θ is 0°, the device port P2 first starts to open, and the aperture ratio of the device port P2 increases depending on the increase in the rotor phase θ in the negative direction. Thereafter, the radiator port P1 starts to open before the aperture ratio of device port P2 reaches 100%, that is, from a position slightly before the position at which the device port P2 is fully opened. As the rotor phase θ increases in the negative direction, the aperture ratio of the device port P2 increases, the device port P2 is fully opened, and the aperture ratio of the radiator port P1 also increases. When the rotor phase θ at which the protruding wall 62B and the stopper 55 abut against each other is defined as −α°, the radiator port P1 is fully opened before the rotor phase θ reaches −α°. Until the rotor phase θ reaches −α° from this state, the device port P2 and the radiator port P1 are fully opened. In this way, in the adjusting valve 30, the end of the movable range of the rotor 60 and the motor 73 in the negative direction is at a position at which the rotor phase θ is −α°. In this phase, the radiator port P1 and the device port P2 are fully opened. When the rotor phase θ is in a range of on the negative side of 0°, the heater port P3 is always fully closed.

As illustrated in FIG. 1, an output signal from the water temperature sensor 24 is input to the control device 130 of the internal combustion engine. In addition to the phase sensor 74 of the adjusting valve 30, the output signals from an air flow meter 25 for detecting the amount of intake air introduced into the combustion chamber of the internal combustion engine, a rotational speed sensor 26 for detecting the rotational speed of the internal combustion engine, a vehicle speed sensor 27 for detecting the speed of the vehicle, a brake sensor 28 for detecting the operating amount of the brake pedal of the vehicle, and the like are also input to the control device 130. The control device 130 controls the adjusting valve 30 at the time of starting the internal combustion engine, based on output signals from the sensors 24, 25, 26, 27, 28 and 74, thereby executing a water stoppage control for speeding up the increase in the temperature of the engine body 200. Further, the control device 130 executes the automatic stop and automatic startup control for automatically stopping the internal combustion engine when the automatic stop condition is satisfied, and automatically starting the internal combustion engine when the automatic startup condition is satisfied.

Figure 7:
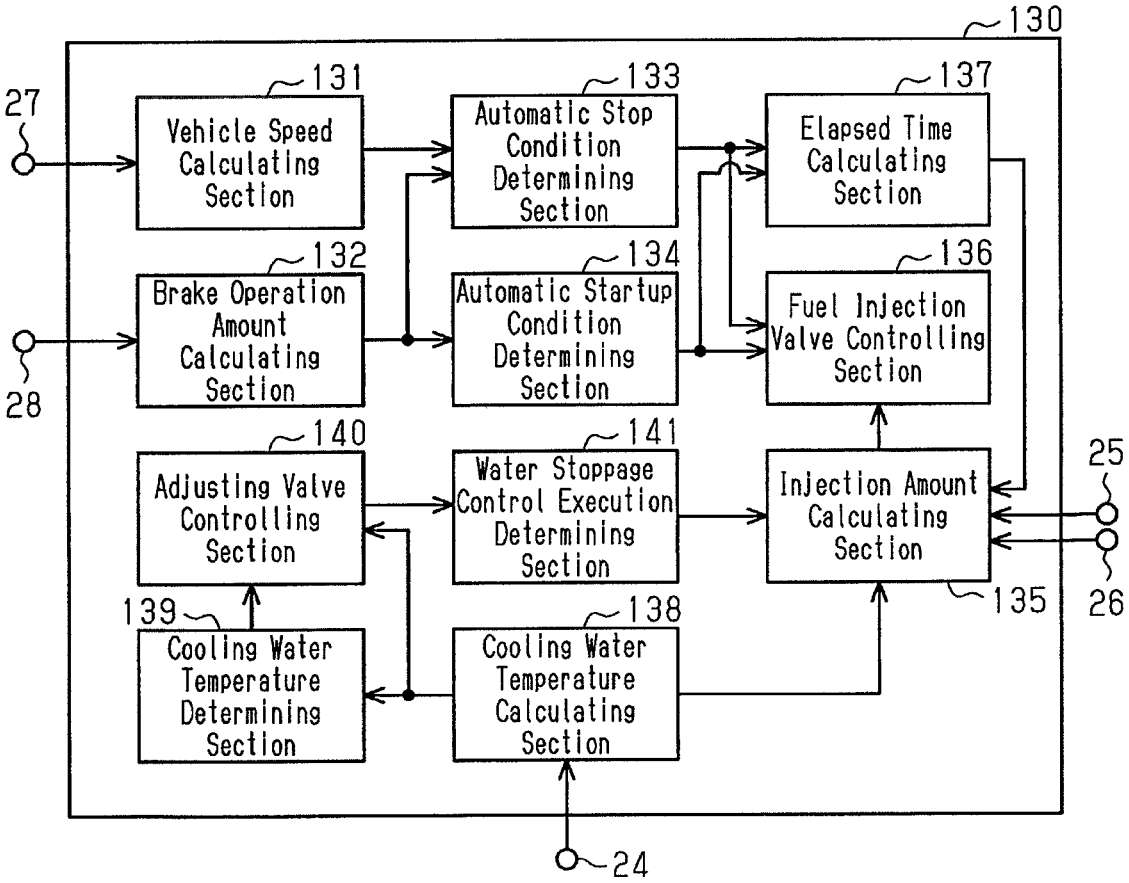
FIG. 7 is a functional block diagram of the control device.

As illustrated in FIG. 7, the control device 130 includes, as functional sections, a vehicle speed calculating section 131, a brake operation amount calculating section 132, an automatic stop condition determining section 133, an automatic startup condition determining section 134, an injection amount calculating section 135, and a fuel injection valve controlling section 136. In addition, the control device 130 includes, as functional sections, an elapsed time calculating section 137, a cooling water temperature calculating section 138, a cooling water temperature determining section 139, an adjusting valve controlling section 140, and a water stoppage control execution determining section 141.

The control device 130 is not limited to a device that performs software processing on all processes executed by itself. For example, the control device 130 may include a dedicated hardware circuit (for example, application specific integrated circuit: ASIC) that performs hardware processing on at least a part of the processing executed by itself. In other words, the control device 130 can be configured as 1) one or more processors that operate in accordance with a computer program (software), 2) one or more dedicated hardware circuits for executing at least partial processes of the various processes, or 3) circuitry including combinations thereof. The processor includes a CPU and memories such as RAM and ROM, and the memory stores program codes or instructions configured to cause the CPU to execute processing. The memory, that is, computer readable medium includes any available media that can be accessed by a general purpose or special purpose computer.

The vehicle speed calculating section 131 calculates the vehicle speed, which is the speed of the vehicle, based on the output signal from the vehicle speed sensor 27. The brake operation amount calculating section 132 calculates the operating amount of the brake pedal, based on the output signal from the brake sensor 28.

The automatic stop condition determining section 133 determines whether the automatic stop condition is satisfied. For example, when the vehicle speed calculated by the vehicle speed calculating section 131 is equal to or less than the predetermined speed, and the operating amount of the brake pedal calculated by the brake operation amount calculating section 132 is equal to or larger than the first predetermined amount, the automatic stop condition determining section 133 determines that the automatic stop condition is satisfied.

The automatic startup condition determining section 134 determines whether the automatic startup condition is satisfied. For example, when the operating amount of the brake pedal calculated by the brake operation amount calculating section 132 is equal to or less than a second predetermined amount smaller than the first predetermined amount, the automatic startup condition determining section 134 determines that the automatic startup condition is satisfied.

The injection amount calculating section 135 calculates the fuel injection amount depending on the operating state of the internal combustion engine, based on the output signals from the air flow meter 25, the rotational speed sensor 26, and the like. Further, when the internal combustion engine is automatically started, the injection amount calculating section 135 calculates the fuel injection amount when the internal combustion engine is automatically started, based on a predetermined map.

The fuel injection valve controlling section 136 controls the fuel injection valves so that the fuel corresponding to the fuel injection amount calculated by the injection amount calculating section 135 is injected. Further, when it is determined by the automatic stop condition determining section 133 that the automatic stop condition is satisfied, the fuel injection valve controlling section 136 stops the fuel injection from the fuel injection valve. As a result, the internal combustion engine is automatically stopped. Thereafter, when it is determined by the automatic startup condition determining section 134 that the automatic startup condition is satisfied, the fuel injection valve controlling section 136 controls the fuel injection valve such that the injection of fuel corresponding to the fuel injection amount calculated by the injection amount calculating section 135 is restarted. As a result, the internal combustion engine is automatically started.

The elapsed time calculating section 137 calculates the elapsed time from the automatic stop of the internal combustion engine until the automatic startup condition of the internal combustion engine is satisfied. The cooling water temperature calculating section 138 calculates the cooling water temperature based on the output signal from the water temperature sensor 24. The cooling water temperature determining section 139 determines whether the cooling water temperature calculated by the cooling water temperature calculating section 138 is within the water stoppage execution temperature range.

The adjusting valve controlling section 140 controls the adjusting valve 30 during the operation of the internal combustion engine based on the cooling water temperature calculated by the cooling water temperature calculating section 138, the rotor phase θ detected by the phase sensor 74, and the like. As a result, the adjusting valve controlling section 140 controls the flow rate of the cooling water flowing through the respective cooling water passages 90, 100, and 110. When the cooling water temperature determining section 139 determines that the cooling water temperature is within the water stoppage execution temperature range at the time of startup of the internal combustion engine, the adjusting valve controlling section 140 starts the water stoppage control until it is determined by the cooling water temperature determining section 139 that the cooling water temperature is equal to or higher than the water stoppage execution temperature range. By executing the water stoppage control, the adjusting valve controlling section 140 sets the rotor phase θ of the adjusting valve 30 to 0°, stops the discharge of the cooling water from the water jacket 20, and suppresses the flow of the cooling water in the water jacket 20.

The water stoppage control execution determining section 141 determines whether the water stoppage control is being executed by the adjusting valve controlling section 140.

Next, the flow of a series of processes relating to the automatic stop and automatic startup control executed by the control device 130 of the internal combustion engine will be described with reference to the flowchart of FIG. 8. This process is repeatedly executed by the control device 130 at predetermined intervals.

Figure 8:
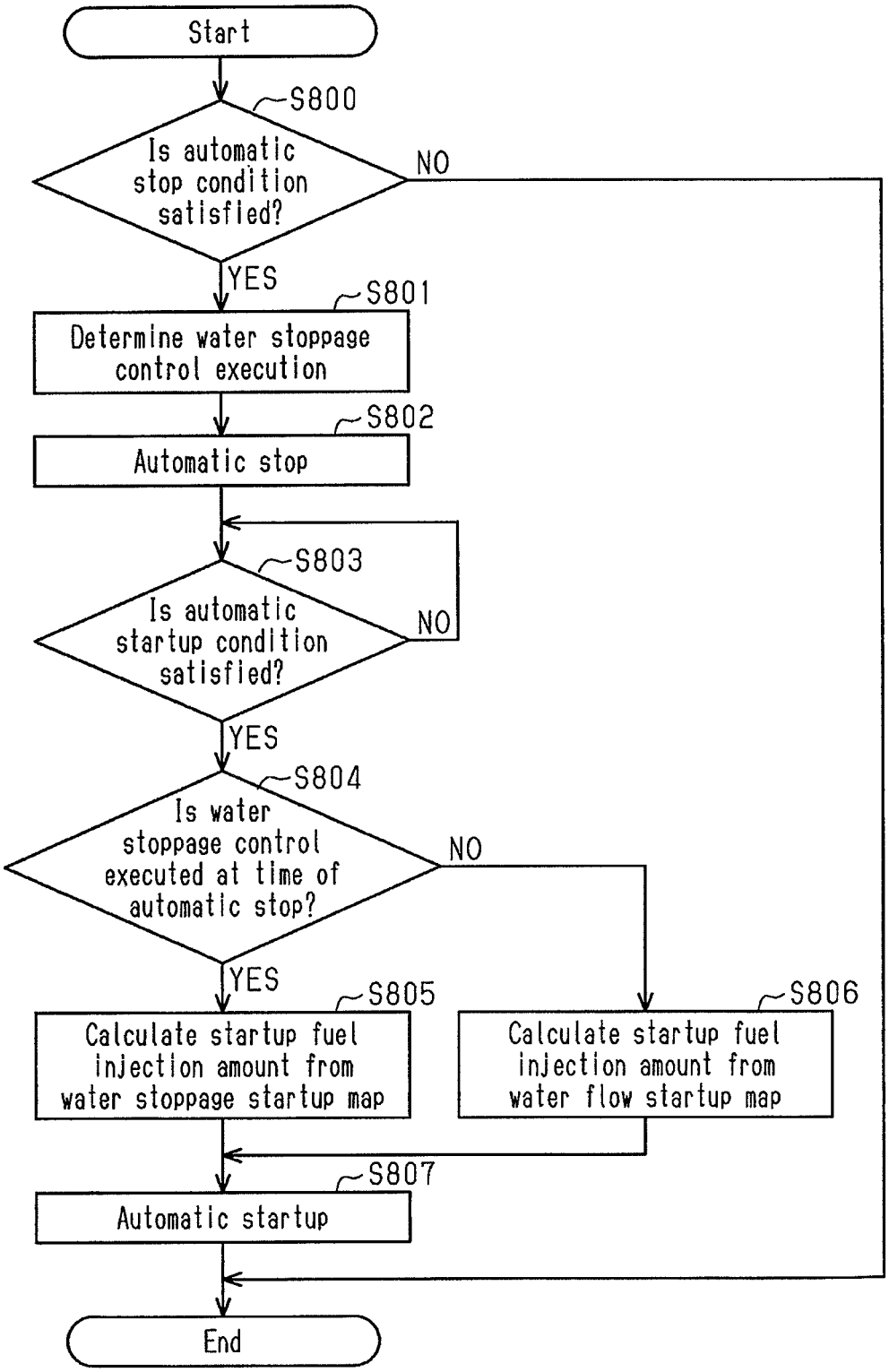
FIG. 8 is a flowchart illustrating the flow of a series of processes relating to automatic stop and automatic startup control.

As illustrated in FIG. 8, when the control device 130 of the internal combustion engine starts the series of processes, first, the automatic stop condition determining section 133 determines whether the automatic stop condition is satisfied (step S800). When the vehicle speed calculated by the vehicle speed calculating section 131 is equal to or less than the predetermined speed and the operating amount of the brake pedal calculated by the brake operation amount calculating section 132 is equal to or larger than the first predetermined amount, the automatic stop condition determining section 133 determines that the automatic stop condition is satisfied (step S800: YES). In this case, the water stoppage control execution determining section 141 determines whether the water stoppage control is being executed by the adjusting valve controlling section 140 (step S801). Determination as to whether the water stoppage control is being executed is performed, for example, based on determination as to whether the water stoppage control is being executed by the adjusting valve controlling section 140. When it is determined whether the water stoppage control is being executed, the fuel injection valve controlling section 136 stops the fuel injection from the fuel injection valve. Thereafter, the internal combustion engine is automatically stopped (step S802). When the internal combustion engine is automatically stopped, the driving of the cooling water pump 22 provided in the cooling water passage 10 is also stopped.

Thereafter, the automatic startup condition determining section 134 determines whether the automatic startup condition is satisfied (step S803). In this process, when the operating amount of the brake pedal calculated by the brake operation amount calculating section 132 exceeds the second predetermined amount, the automatic startup condition determining section 134 determines that the automatic startup condition is not satisfied (step S803: NO). In this way, when a negative determination is made in the processing of step S803, the automatic startup condition determining section 134 repeats the processing of step S803, without proceeding to the next process. Thereafter, when the operating amount of the brake pedal calculated by the brake operation amount calculating section 132 becomes equal to or less than the second predetermined amount, the automatic startup condition determining section 134 determines that the automatic startup condition is satisfied (step S803: YES).

When the automatic startup condition determining section 134 determines that the automatic startup condition is satisfied, the injection amount calculating section 135 calculates the startup fuel injection amount, which is the fuel injection amount for automatically starting the internal combustion engine. When calculating the startup fuel injection amount, the injection amount calculating section 135 first determines whether the water stoppage control has been executed when the internal combustion engine is automatically stopped (step S804). That is, the injection amount calculating section 135 determines whether it has been determined by the water stoppage control execution determining section 141 that the water stoppage control is being executed in the process of step S801. In a case where it is determined that the water stoppage control has been executed when the internal combustion engine is automatically stopped (step S804: YES), the injection amount calculating section 135 proceeds to the process of step S805 and calculates the startup fuel injection amount from the water stoppage startup map. Further, in a case where it is determined that the water stoppage control is not being executed when the internal combustion engine is automatically stopped (step S804: NO), the injection amount calculating section 135 proceeds to the process of step S806, and calculates the startup fuel injection amount from the water flow startup map.

Figures 9, 10A, 10B:
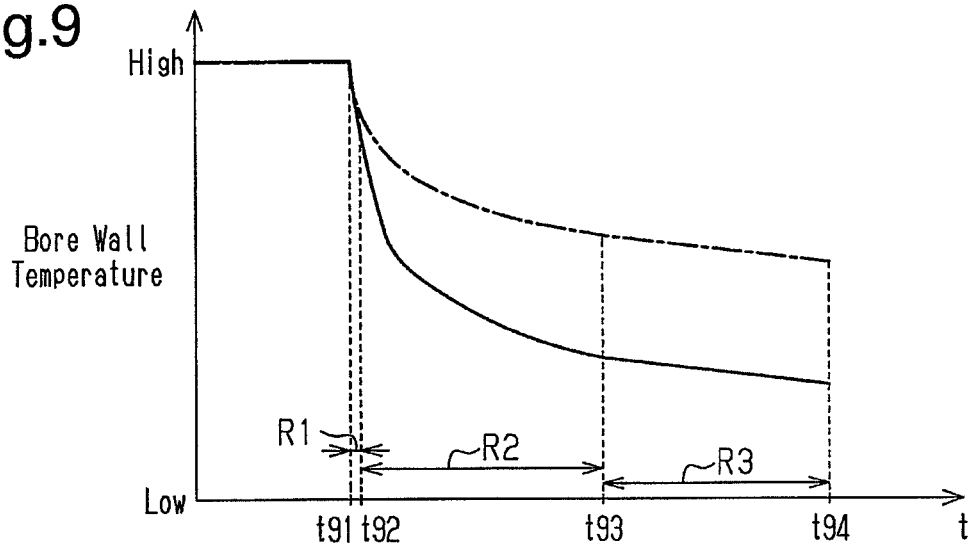
FIG. 9 is a graph illustrating movements of the bore wall temperature.
FIG. 10A is a map for calculating a water stoppage injection amount.
FIG. 10B is a map for calculating a water flow injection amount.

The solid line of FIG. 9 indicates the degree of decrease in the bore wall temperature when the internal combustion engine is automatically stopped in a case where the water stoppage control is being executed, and the long dashed short dashed line of FIG. 9 indicates the degree of decrease in the bore wall temperature when the internal combustion engine is automatically stopped in a case where the water stoppage control is not being executed, respectively. This graph illustrates the degree of decrease in the bore wall temperature in a case where the water stoppage control is being executed, and the degree of decrease in the bore wall temperature in a case where the water stoppage control is not being executed, when the internal combustion engine is automatically stopped in a state in which both bore wall temperatures are virtually the same when the internal combustion engine is automatically stopped.

As illustrated in FIG. 9, when the internal combustion engine continues to be stopped, the bore wall temperature decreases due to heat radiation or the like. When the water stoppage control is not being executed, since the cooling water flows through the water jacket 20 during the operation of the internal combustion engine, the temperature of the cooling water in the water jacket 20 is substantially equalized. As indicated by the long dashed short dashed line in FIG. 9, the bore wall temperature in a case where the internal combustion engine is automatically stopped when the water stoppage control is not being executed significantly decreases at a first predetermined period R1 (point in time t91 to point in time t92) to the point in time t92, at which the first predetermined time elapses from the automatic stop of the internal combustion engine at the point in time t91. This is because the heat input from the heat source to the cooling water temperature around the bore was stopped. Further, at a second predetermined period R2 (point in time t92 to point in time t93) to the point in time t93, at which the second predetermined time has elapsed from the elapse of the first predetermined period R1, the bore wall temperature gradually decreases due to the influence of heat radiation or the like from the internal combustion engine. Therefore, the degree of decrease in the bore wall temperature at the second predetermined period R2 is gentler than the degree of decrease in the bore wall temperature at the first predetermined period R1. Also after the second predetermined period R2, the bore wall temperature gradually decreases due to the influence of heat radiation from the internal combustion engine or the like.

In contrast, when the water stoppage control is being executed, the flow of cooling water in the water jacket 20 is stopped even while the internal combustion engine is in operation. Therefore, in the water jacket 20, the temperature of the portion around the bore and the like near the heat source locally becomes high and the like, and thus, the temperature distribution of the cooling water becomes uneven. When the internal combustion engine continues to be stopped under such a condition, heat is diffused from high-temperature cooling water around the bore to low-temperature cooling water or the like around the bore. As indicated by the solid line in FIG. 9, the bore wall temperature in a case where the internal combustion engine is automatically stopped when the water stoppage control is being executed significantly drops at the first predetermined period R1. This is because the heat input from the heat source to the cooling water temperature around the bore is stopped. The degree of decrease in the bore wall temperature at this time is substantially equal to the degree of decrease in the bore wall temperature of the case where the internal combustion engine is automatically stopped when the water stoppage control is not being executed. Thereafter, at the second predetermined period R2, the unevenness of the temperature distribution of the cooling water in the water jacket 20 is eliminated, thereby lowering the temperature of the bore wall temperature. In this way, in the course of making the cooling water temperature uniform, the cooling water temperature around the bore may be significantly reduced as compared with just before the stop of the internal combustion engine. Along with this, the degree of decrease in the bore wall temperature increases. In this way, when the water stoppage control is being executed (solid line of FIG. 9), the degree of decrease in the bore wall temperature at the second predetermined period R2 is larger than the case where the water stoppage control is not being executed (the long dashed short dashed line in FIG. 9) due to the unevenness of the temperature distribution of the cooling water in the water jacket 20. Accordingly, at the second predetermined period R2, as the elapsed time becomes longer, the difference in bore wall temperature increases between when the water stoppage control is being executed (the solid line of FIG. 9) and when the water stoppage control is not being executed (the long dashed short dashed line of FIG. 9).

Thereafter, the degree of decrease in the bore wall temperature at the third predetermined period R3 (point in time t93 to point in time t94) to the point in time t94, at which the third predetermined time has elapsed from the elapse of the second predetermined period R2 becomes gentler than the degree of decrease in the bore wall temperature at the second predetermined period R2. This is because the unevenness of the temperature distribution of the cooling water in the water jacket 20 is being eliminated at the third predetermined period R3, and the degree of decrease in the bore wall temperature is predominately influenced by heat radiation from the internal combustion engine or the like. The degree of decrease in the bore wall temperature at the third predetermined period R3 is gentler than the degree of decrease in the bore wall temperature in the process in which the temperature distribution of the cooling water is made uniform at the second predetermined period R2. The degree of decrease in the bore wall temperature at the third predetermined period R3 does not change significantly even when the water stoppage control is being executed (the solid line of FIG. 9) or even when the water stoppage control is not being executed (the long dashed short dashed line of FIG. 9).

For this reason, in the first embodiment, the water stoppage startup map and the water flow startup map are set as follows.

That is, as illustrated in FIGS. 10A and 10B, the startup fuel injection amount is calculated based on the cooling water temperature and the elapsed time, which are parameters related to the bore wall temperature. The cooling water temperature is the cooling water temperature calculated by the cooling water temperature calculating section 138 when the automatic startup condition is satisfied. The elapsed time is elapsed time from the automatic stop of the internal combustion engine until the automatic startup condition of the internal combustion engine is satisfied, and is calculated by the elapsed time calculating section 137. The water stoppage startup map and the water flow startup map are obtained through experiments or simulations in advance, and are stored in the injection amount calculating section 135. Hereinafter, the cooling water temperature for calculating the startup fuel injection amount in a case where the water stoppage control is being executed when the internal combustion engine is automatically stopped is set as the water stoppage cooling water temperature, and the elapsed time for calculating the startup fuel injection amount is set as a water stoppage elapsed time. Further, the cooling water temperature for calculating the startup fuel injection amount in a case where the water stoppage control is not being executed when the internal combustion engine is automatically stopped is set as a water flow cooling water temperature, and the elapsed time for calculating the startup fuel injection amount is set as a water flow elapsed time. In addition, the startup fuel injection amount in a case where the water stoppage control is being executed when the internal combustion engine is automatically stopped is set as a water stoppage injection amount, and the startup fuel injection amount in a case where the water stoppage control is not being executed when the internal combustion engine is automatically stopped is set as a water flow injection amount.

As illustrated in FIG. 10A, in the water stoppage startup map, the startup fuel injection amount is set to be larger as the water stoppage cooling water temperature decreases. Also, in the water stoppage startup map, the startup fuel injection amount is set to be larger as the water stoppage elapsed time becomes longer. In FIG. 10A, n is an arbitrary number that is greater than or equal to 1. Also, k, l, and m are arbitrary numbers greater than 1 and less than n, and have a relationship of $1<k<l<m<n$.

In addition, as illustrated in FIG. 10B, in the water flow startup map, the startup fuel injection amount is set to be larger as the water flow cooling water temperature decreases. Further, in the water flow startup map, the startup fuel injection amount is set to be larger as the water flow elapsed time becomes longer. In FIG. 10B, n is an arbitrary number that is greater than or equal to 1. Also, k, l, and m are arbitrary numbers greater than 1 and less than n, and have a relationship of $1<k<l<m<n$.

The bore wall temperature tends to be lower as the cooling water temperature when performing the automatic startup decreases. When the bore wall temperature decreases, the vaporability of the injected fuel decreases, and the amount of fuel vaporized in the combustion chamber, that is, the amount of fuel contributing to combustion decreases. In consideration of such a tendency, both the water stoppage startup map and the water flow startup map are set to ensure the amount of fuel contributing to combustion by increasing the startup fuel injection amount as the cooling water temperature calculated at the time of the automatic startup is low. Further, as described above, the bore wall temperature decreases as the elapsed time from the automatic stop to the automatic startup is long. Therefore, both the water stoppage startup map and the water flow startup map are set to ensure the amount of fuel contributing to combustion by increasing the startup fuel injection amount as the elapsed time becomes longer.

Further, as illustrated in FIG. 9, the degree of decrease in the bore wall temperature (solid line of FIG. 9) in a case where the internal combustion engine is automatically stopped when the water stoppage control is being executed is larger than the degree of decrease in the bore wall temperature (long dashed short dashed line of FIG. 9) in a case where the internal combustion engine is automatically stopped when the water stoppage control is not being executed. As described above, a relationship between the cooling water temperature calculated for automatically starting the internal combustion engine and the bore wall temperature estimated from the cooling water temperature is different between when the water stoppage control is being executed and when the water stoppage control is not being executed. Therefore, under the condition that the water stoppage cooling water temperature and the water flow cooling water temperature are the same cooling water temperature ck and the water stoppage elapsed time and the water flow elapsed time are the same elapsed time tk, the startup fuel injection amount is set such that a water stoppage injection amount Q1*kk* calculated based on the water stoppage startup map as illustrated in FIG. 10A is larger than a water flow injection amount Q2*kk* calculated based on the water flow startup map illustrated in FIG. 10B (Q1*kk*>Q2*kk*). Therefore, under the condition that the water stoppage cooling water temperature and the water flow cooling water temperature are the same cooling water temperature, and the water stoppage elapsed time and the water flow elapsed time are the same elapsed time, the startup fuel injection amount in a case where the water stoppage control is being executed when the internal combustion engine is automatically stopped is enhanced further than the startup fuel injection amount in a case where the water stoppage control is not being executed when the internal combustion engine is automatically stopped. Further, under the condition that the cooling water temperature is the same during the operation of the internal combustion engine, the bore wall temperature when executing the water stoppage control tends to become higher than the bore wall temperature when the water stoppage control is not being executed. Such a difference in the bore wall temperature is also reflected on the difference between the water stoppage injection amount (for example, Q1*kk*) calculated based on the water stoppage startup map and the water flow injection amount (for example, Q2*kk*) calculated based on the water flow startup map.

Further, in the water stoppage startup map and the water flow startup map, under the condition that the water stoppage cooling water temperature and the water flow cooling water temperature are the same cooling water temperature, and the water stoppage elapsed time and the water flow elapsed time are the same elapsed time, the startup fuel injection amount is set such that the difference between the water stoppage injection amount and the water flow injection amount becomes larger at the second predetermined period R2 than at the first predetermined period R1. That is, for example, the difference between the water stoppage injection amount Q111 and the water flow injection amount Q211 at the first predetermined period R1 when the water stoppage cooling water temperature and the water flow cooling water temperature are the same cooling water temperature c1 and the water stoppage elapsed time and the water flow elapsed time are the same elapsed time t1 is set as a first injection amount difference Δ11 (Δ11=Q111−Q211). Further, the difference between the water stoppage injection amount Q1*k*1 and the water flow injection amount Q2*k*1 at the second predetermined period R2 when the water stoppage cooling water temperature and the water flow cooling water temperature are the same cooling water temperature c1 and the water stoppage elapsed time and the water flow elapsed time are the same elapsed time tk (tk>t1) is set as a second injection amount difference Δk1 (Δk1=Q1*k*1−Q2*k*1). In this case, the second injection amount difference Δk1 is larger than the first injection amount difference Δ11 (Δ11<Δk1).

Further, in the water stoppage startup map, at the second predetermined period R2, the difference between the water stoppage injection amount and the water flow injection amount when the elapsed time is long is set to be larger than the difference when the elapsed time is short. That is, for example, the difference between a water stoppage injection amount Q111 and a water flow injection amount Q211 at the second predetermined period R2 when the water stoppage cooling water temperature and the water flow cooling water temperature are the same cooling water temperature c1 and the water stoppage elapsed time and the water flow elapsed time are the same elapsed time t1 (t1>tk) is defined as a third injection amount difference Δ11 (A11=Q111−Q211). In this case, the third injection amount difference Δ11 is larger than the second injection amount difference Δk1 (Δk1<Δ11).

Further, in the water stoppage startup map, the difference between the water stoppage injection amount and the water flow injection amount at the third predetermined period is made constant. That is, for example, when the water stoppage cooling water temperature and the water flow cooling water temperature are the same cooling water temperature c1 and the water stoppage elapsed time and the water flow elapsed time are the same elapsed time tm, the difference between the water stoppage injection amount Q1*m*1 and the water flow injection amount Q2*m*1 at the third predetermined period R3 is set as a fourth injection amount difference Δm1 (Δm1=Q1*m*1−Q2*m*1). Also, when the water stoppage cooling water temperature and the water flow cooling water temperature are the same cooling water temperature c1 and the water stoppage elapsed time and the water flow elapsed time are the same elapsed time tn (tn>tm), the difference between the water stoppage injection amount Q1*n*1 and the water flow injection amount Q2*n*1 at the third predetermined period R3 is set as a fifth injection amount difference Δn1 (Δn1=Q1*n*1−Q2*n*1). In this case, the fourth injection amount difference Δm1 and the fifth injection amount difference Δn1 are the same (Δm1=Δn16). The term "same" as used herein does not mean only the case where two values are completely identical to each other, but also includes a case where the difference between these is about several percent, and a case where both are not completely identical to each other.

As illustrated in FIG. 8, in a case where the startup fuel injection amount is calculated from the water stoppage startup map in the process of step S805, and in a case where the startup fuel injection amount is calculated from the water flow startup map in the process of step S806, the fuel injection valve controlling section 136 controls the fuel injection valve so that the fuel corresponding to the startup fuel injection amount calculated by the injection amount calculating section 135 is injected. As a result, the internal combustion engine is automatically started (step S807). When the internal combustion engine is automatically started, the control device 130 terminates a series of processes related to the automatic stop and automatic startup control. When the automatic startup of the internal combustion engine is completed, the injection amount calculating section 135 calculates the fuel injection amount based on the output signals from the air flow meter 25, the rotational speed sensor 26, and the like, rather than each startup map described above. The fuel injection amount thus calculated corresponds to the operating state of the internal combustion engine. After the internal combustion engine is automatically started, the fuel injection valve controlling section 136 controls the fuel injection valve based on the fuel injection amount calculated in accordance with the operating state of the internal combustion engine by the injection amount calculating section 135. As a result, an amount of fuel corresponding to the operating state of the internal combustion engine is supplied to the combustion chamber.

In contrast, in the process of step S800, when it is determined by the automatic stop condition determining section 133 that the automatic stop condition is not satisfied (step S800: NO), the control device 130 does not perform the subsequent processes, and terminates a series of processes relating to the automatic stop and automatic startup control.

Operational advantages of the first embodiment will now be described with reference to FIGS. 11A to 11H.

Figures 11A, 11B, 11C, 11D, 11E, 11F, 11G, 11H:
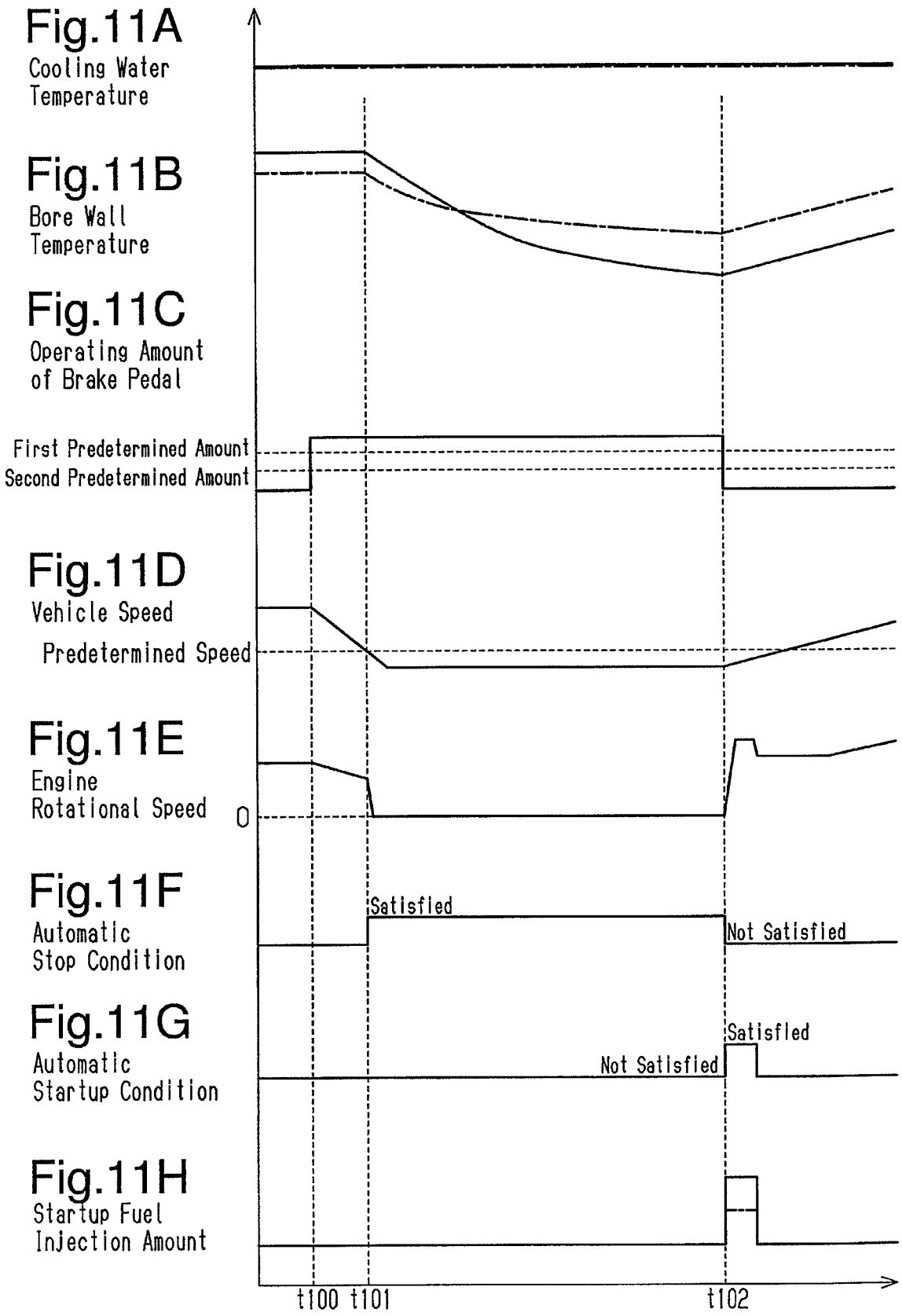
FIGS. 11A to 11H are timing diagrams illustrating movements of each parameter in the automatic stop and automatic startup control.

(1) As illustrated in FIG. 11C, when the brake pedal is operated at a point in time t100, the vehicle speed decreases as illustrated in FIG. 11D. Further, at a point in time t101, at which the operating amount of the brake pedal is equal to or higher than the first predetermined amount and the vehicle speed becomes equal to or less than the predetermined speed, the automatic stop condition is satisfied as illustrated in FIG. 11F. When the internal combustion engine automatically stops at the point in time t101, at which the automatic stop condition is satisfied, the engine rotational speed, which is the rotational speed of the internal combustion engine, becomes 0 as illustrated in FIG. 11E. As the automatic stop of the internal combustion engine continues, the bore wall temperature decreases as illustrated in FIG. 11B. In the example illustrated in FIGS. 11A to 11H, the cooling water temperature in the vicinity of the outlet part of the water jacket 20 detected by the water temperature sensor 24 while the water stoppage control is being executed as indicated by the solid line in FIG. 11A is the same as the cooling water temperature in the vicinity of the outlet part of the water jacket 20 detected by the water temperature sensor 24 when the water stoppage control is not being executed as indicated by the long dashed short dashed line in FIG. 11A. In this case, as illustrated in FIG. 11B, before the internal combustion engine is automatically stopped, the bore wall temperature (solid line of FIG. 11B) in a case where the internal combustion engine is automatically stopped while the water stoppage control is being executed is higher than the bore wall temperature (long dashed short dashed line of FIG. 11B) in a case where the internal combustion engine is automatically stopped when the water stoppage control is not being executed. As described above, the degree of decrease in the bore wall temperature in a case where the internal combustion engine is automatically stopped while the water stoppage control is being executed is larger than the degree of decrease in the bore wall temperature in a case where the internal combustion engine is automatically stopped when the water stoppage control is not being executed. Therefore, as illustrated in FIG. 11B, the bore wall temperature in a case where the internal combustion engine is automatically stopped while the water stoppage control is being executed is lower than the bore wall temperature in a case where the internal combustion engine is automatically stopped when the water stoppage control is not being executed, at the second predetermined period R2.

As illustrated in FIG. 11A, even when the water stoppage control is not being executed and even when the water stoppage control is being executed, the cooling water temperature in the vicinity of the outlet part of the water jacket 20 detected by the water temperature sensor 24 does not decrease significantly. Therefore, the difference between the detected cooling water temperature and the bore wall temperature is different between when the water stoppage control is not being executed and when the water stoppage control is being executed.

As illustrated in FIG. 11C, when the operating amount of the brake pedal becomes equal to or less than the second predetermined amount at the point in time t102 after the automatic stop of the internal combustion engine, the automatic startup condition is satisfied as illustrated in FIG. 11G. As a result, as illustrated in FIG. 11H, the startup fuel injection amount is calculated. In this case, the startup fuel injection amount in a case where the water stoppage control is being executed when the internal combustion engine is automatically stopped as illustrated by the solid line in FIG. 11H is increased as compared with the startup fuel injection amount in a case where the water stoppage control is not being executed when the internal combustion engine is automatically stopped as indicated by the long dashed short dashed line in FIG. 11H. As the fuel corresponding to the startup fuel injection amount thus calculated is injected from the fuel injection valve, the internal combustion engine is automatically started. In this way, even in a case where the water stoppage control is being executed when the internal combustion engine is automatically stopped and the degree of decrease in the bore wall temperature is large, since the startup fuel injection amount is increased, it is possible to more reliably start the internal combustion engine. Therefore, in a case where the internal combustion engine is automatically stopped while the water stoppage control is being executed, the control accuracy when the internal combustion engine is automatically started is improved.

(2) The startup fuel injection amount is calculated based on the cooling water temperature and the elapsed time from the automatic stop by using the water stoppage startup map and the water flow startup map. It is possible to calculate the fuel injection amount suitable for the movements of the temperature decrease of the bore wall temperature after the automatic stop based on the cooling water temperature and the elapsed time. Further, under the condition that the water stoppage cooling water temperature and the water flow cooling water temperature are the same cooling water temperature and the water stoppage elapsed time and the water flow elapsed time are the same elapsed time, in a case where the water stoppage control is being executed when the internal combustion engine is automatically stopped, the water stoppage injection amount calculated based on the water stoppage startup map is set to be larger than the water flow injection amount calculated based on the water flow startup map. Therefore, when the water stoppage cooling water temperature and the water flow cooling water temperature are the same cooling water temperature, and the water stoppage elapsed time and the water flow elapsed time are the same elapsed time, the startup fuel injection amount in a case where the water stoppage control is being executed when the internal combustion engine is automatically stopped is increased as compared with the startup fuel injection amount in a case where the water stoppage control is not being executed when the internal combustion engine is automatically stopped. As a result, the degree of decrease in the bore wall temperature is significantly provided. Thus, it is possible to adequately control the fuel injection amount when the internal combustion engine is automatically started.

(3) Under the condition that the water stoppage cooling water temperature and the water flow cooling water temperature are the same cooling water temperature, and the water stoppage elapsed time and the water flow elapsed time are the same elapsed time, the startup fuel injection amount is set such that the difference between the water stoppage injection amount and the water flow injection amount becomes larger at the second predetermined period R2 than at the first predetermined period R1. The degree of decrease in the bore wall temperature of the first predetermined period R1 immediately after the internal combustion engine is automatically stopped is predominantly determined by the stoppage of the heat input from the heat source. For this reason, the difference between the degree of decrease in the bore wall temperature when executing the water stoppage control and the degree of decrease in the bore wall temperature when not executing the water stoppage control is not significantly large. On the other hand, the degree of decrease in the bore wall temperature of the second predetermined period R2 is predominantly determined by the temperature distribution of the cooling water in the water jacket 20. Further, when the water stoppage control is being executed, there is unevenness of the temperature distribution of the cooling water in the water jacket 20. Therefore, the degree of decrease in the bore wall temperature when executing the water stoppage control tends to be larger than the degree of decrease in the bore wall temperature when not executing the water stoppage control.

Taking such a tendency into consideration, the difference between the startup fuel injection amount when the water stoppage control is being executed and the startup fuel injection amount when the water stoppage control is not being executed is increased at the second predetermined period R2 than at the first predetermined period R1. Therefore, at the second predetermined period R2, in which the degree of decrease in the bore wall temperature during the automatic stop is large due to execution of the water stoppage control, when the water stoppage control is being executed, a larger amount of fuel is injected at the time of the automatic startup. Therefore, in a-case where the internal combustion engine is automatically stopped while the water stoppage control is being executed, the startability when the internal combustion engine is automatically started is improved.

(4) The degree of decrease in the bore wall temperature of the second predetermined period R2 is predominantly determined by unevenness of the cooling water temperature in the water jacket 20. For this reason, the degree of decrease in the bore wall temperature when executing the water stoppage control tends to be larger than the degree of decrease in the bore wall temperature when not executing the water stoppage control. Therefore, at the second predetermined period R2, the difference between the bore wall temperature when the water stoppage control is being executed and the bore wall temperature when the water stoppage control is not being executed when the elapsed time is long tends to be larger than the difference when the elapsed time is short.

In consideration of such a difference in degree of decrease in the bore wall temperature, in the water stoppage startup map, the difference between the water stoppage injection amount and the water flow injection amount when the elapsed time is long at the second predetermined period R2 is larger than the difference when the elapsed time is short. Therefore, when the elapsed time at the second predetermined period R2 is long, as compared with a case where the elapsed time is short, the startup fuel injection amount can be more increased when the water stoppage control is being executed. Therefore, it is possible to adequately calculate the fuel injection amount at the time of automatic startup at the second predetermined period R2.

(5) At the third predetermined period R3 after the second predetermined period R2 has elapsed, the unevenness due to the temperature distribution of the cooling water in the water jacket 20 is eliminated, and the degree of decrease in the bore wall temperature is predominantly influenced by heat radiation or the like from the internal combustion engine. Therefore, after the elapse of the second predetermined period R2, the degree of decrease in the bore wall temperature does not change significantly even when the water stoppage control is being executed, or even when the water stoppage control is not being executed. In consideration of this tendency, the difference between the water stoppage injection amount and the water flow injection amount at the third predetermined period R3 is made constant. Accordingly, it is possible to adequately calculate the fuel injection amount at the time of the automatic startup at the third predetermined period R3.

Second Embodiment

A control device for an internal combustion engine according to a second embodiment will be described with reference to FIG. 12. The second embodiment is different from the first embodiment in the flow of a series of processes relating to the automatic stop and automatic startup control. Components similar to those in the first embodiment are denoted by common reference numerals, and description thereof will not be provided.

Figure 12:
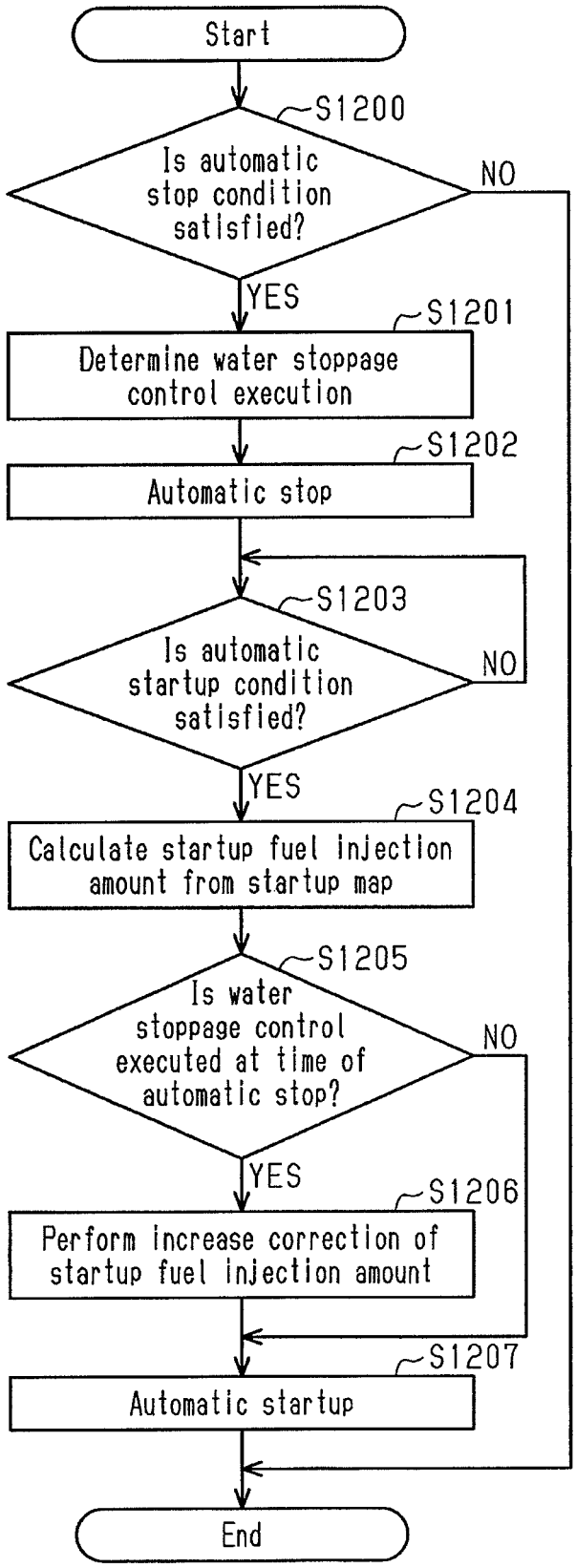
FIG. 12 is a flowchart illustrating the flow of a series of processes relating to the automatic stop and automatic startup control executed by a control device of an internal combustion engine according to a second embodiment of the present disclosure.

As illustrated in FIG. 12, when a control device 230 of the internal combustion engine starts the series of processes, the automatic stop condition determining section 133 first determines whether the automatic stop condition is satisfied (step S1200). When the vehicle speed calculated by the vehicle speed calculating section 131 is equal to or less than the predetermined speed and the operating amount of the brake pedal calculated by the brake operation amount calculating section 132 is equal to or larger than the first predetermined amount, the automatic stop condition determining section 133 determines that the automatic stop condition is satisfied (step S1200: YES). In this case, the water stoppage control execution determining section 141 determines whether the water stoppage control is being executed by the adjusting valve controlling section 140 (step S1201). The determination as to whether the water stoppage control is being executed is made based on, for example, whether the water stoppage control is being executed by the adjusting valve controlling section 140. When it is determined whether the water stoppage control is being executed, the fuel injection valve controlling section 136 stops the fuel injection from the fuel injection valve. Thereafter, the internal combustion engine is automatically stopped (step S1202). When the internal combustion engine is automatically stopped, the driving of the cooling water pump 22 provided in the cooling water passage 10 is also stopped.

Thereafter, the automatic startup condition determining section 134 determines whether the automatic startup condition is satisfied (step S1203). In this process, when the operating amount of the brake pedal calculated by the brake operation amount calculating section 132 exceeds the second predetermined amount, the automatic startup condition determining section 134 determines that the automatic startup condition is not satisfied (step S1203: NO). In this way, when a negative determination is made in the process of step S1203, the automatic startup condition determining section 134 repeats the process of step S1203 without proceeding to the next process. Thereafter, when the operating amount of the brake pedal calculated by the brake operation amount calculating section 132 becomes equal to or less than the second predetermined amount, the automatic startup condition determining section 134 determines that the automatic startup condition is satisfied (step S1203: YES).

When it is determined by the automatic startup condition determining section 134 that the automatic startup condition is satisfied, the injection amount calculating section 135 calculates the startup fuel injection amount, which is the fuel injection amount for automatically starting the internal combustion engine. When calculating the startup fuel injection amount, the injection amount calculating section 135 first calculates the startup fuel injection amount from the startup map (step S1204). The startup map is the same map as the water flow startup map in the first embodiment. The startup map is obtained through experiments or simulations in advance in accordance with the movements of the bore wall temperature in a case where the water stoppage control is not being executed when the internal combustion engine is automatically stopped, and the startup map is stored in the injection amount calculating section 135. That is, in the startup map, the startup fuel injection amount is set based on the cooling water temperature and the elapsed time, which are parameters related to the bore wall temperature. The cooling water temperature is the cooling water temperature calculated by the cooling water temperature calculating section 138 when the automatic startup condition is satisfied. Further, the elapsed time is an elapsed time from the automatic stop of the internal combustion engine until the automatic startup condition of the internal combustion engine is satisfied, and is calculated by the elapsed time calculating section 137. In the startup map, the startup fuel injection amount is set to be larger as the cooling water temperature calculated by the cooling water temperature calculating section 138 is lower when the automatic startup condition is satisfied. Further, in the startup map, the startup fuel injection amount is set to be larger as the elapsed time from the automatic stop of the internal combustion engine until the automatic startup condition of the internal combustion engine is satisfied is longer.

When calculating the startup fuel injection amount from the startup map, the injection amount calculating section 135 determines whether the water stoppage control is being executed when the internal combustion engine is automatically stopped (step S1205). That is, the injection amount calculating section 135 determines whether it has been determined by the water stoppage control execution determining section 141 that the water stoppage control is being executed in the process of step S1201. In a case where the water stoppage control is being executed when the internal combustion engine is automatically stopped (step S1205: YES), the injection amount calculating section 135 proceeds to the process of step S1206 and performs the increase correction of the startup fuel injection amount calculated from the startup map in step S1204. The increase correction of the startup fuel injection amount is performed, for example, by multiplying the startup fuel injection amount calculated from the startup map by a fixed correction value set in advance. The correction value is a number greater than 1. The correction value is obtained through experiments or simulations in advance in accordance with the movements of the bore wall temperature when the water stoppage control is being executed when the internal combustion engine is automatically stopped, and the correction value is stored in the injection amount calculating section 135.

On the other hand, in a case where it is determined that the water stoppage control is not being executed when the internal combustion engine is automatically stopped (step S1205: NO), the injection amount calculating section 135 does not proceed to the process of step S1206 and does not perform the increase correction of the startup fuel injection amount calculated from the startup map.

Thereafter, the control device 230 of the internal combustion engine proceeds to the process of step S1207. The fuel injection valve controlling section 136 controls the fuel injection valve so that the fuel corresponding to the startup fuel injection amount calculated by the injection amount calculating section 135 is injected. As a result, the internal combustion engine is automatically started. That is, in the process of step S1207, in a case where the water stoppage control is being executed when the internal combustion engine is automatically stopped, the automatic startup is performed, by injecting the fuel corresponding to the startup fuel injection amount after performing the increase correction of the startup fuel injection amount calculated from the startup map. Further, in a case where the water stoppage control is not being executed when the internal combustion engine is automatically stopped, the automatic startup is performed by injecting fuel corresponding to the startup fuel injection amount calculated from the startup map.

When the internal combustion engine is automatically started, the control device 230 terminates a series of processes relating to the automatic stop and automatic startup control. When the automatic startup of the internal combustion engine is completed, the injection amount calculating section 135 calculates the fuel injection amount based on the output signals from the air flow meter 25, the rotational speed sensor 26, or the like, rather than based on the above-described startup map. The fuel injection amount thus calculated corresponds to the operating state of the internal combustion engine. After the internal combustion engine is automatically started, the fuel injection valve controlling section 136 controls the fuel injection valve based on the fuel injection amount calculated in accordance with the operating state of the internal combustion engine by the injection amount calculating section 135. As a result, an amount of fuel corresponding to the operating state of the internal combustion engine is supplied to the combustion chamber.

In contrast, in the process of step S1200, when it is determined by the automatic stop condition determining section 133 that the automatic stop condition is not satisfied (step S1200: NO), the control device 230 does not perform the subsequent processes and terminates the series of processes relating to the automatic stop and automatic startup control.

The second embodiment has the following advantages.

(6) In a case where the water stoppage control is not being executed when the internal combustion engine is automatically stopped, the automatic startup is performed based on the startup fuel injection amount calculated from the startup map. The startup map is a map for calculating the startup fuel injection amount based on the cooling water temperature and the elapsed time after the automatic stop. The startup map is set in relation to the cooling water temperature and the elapsed time so that the fuel injection amount matches the movements of the temperature decrease of the bore wall temperature in a case where the water stoppage control is not being executed when the internal combustion engine is automatically stopped. Therefore, in a case where the internal combustion engine is automatically stopped when the water stoppage control is not being executed, it is possible to ensure the startability when the internal combustion engine is automatically started.

Further, in a case where the water stoppage control is being executed when the internal combustion engine is automatically stopped, the startup fuel injection amount calculated from the startup map is subjected to the increase correction by the correction value. That is, under the condition that the water stoppage cooling water temperature and the water flow cooling water temperature are the same cooling water temperature and the water stoppage elapsed time and the water flow elapsed time are the same elapsed time, the startup fuel injection amount in a case where the water stoppage control is being executed when the internal combustion engine is automatically stopped is increased as compared with the startup fuel injection amount in a case where the water stoppage control is not being executed when the internal combustion engine is automatically stopped. In this way, when the internal combustion engine is automatically stopped, the water stoppage control is being executed, and when the degree of decrease in the bore wall temperature is large, the startup fuel injection amount is subjected to the increase correction. Thus, the startability of the internal combustion engine can be more reliably ensured. Therefore, in a case where the internal combustion engine is automatically stopped while the water stoppage control is being executed, the control accuracy when the internal combustion engine is automatically started is improved.

(7) By multiplying the startup fuel injection amount calculated using the startup map by the correction value, which is a fixed value, the water stoppage injection amount, which is the startup fuel injection amount in a case where the water stoppage control is being executed when the internal combustion engine is automatically stopped, is calculated. In this case, it is unnecessary to provide a map for calculating the water stoppage injection amount. Therefore, the storage capacity of the injection amount calculating section 135 can be reduced as compared with a configuration in which the map for calculating the water stoppage injection amount in addition to the startup map is stored in the injection amount calculating section 135.

Each of the embodiments may be modified as follows. Also, two or more of the following modifications may be combined as necessary.

In the first embodiment, the difference between the water stoppage injection amount and the water flow injection amount at the third predetermined period R3 is made constant, but the configuration is not limited to this configuration. For example, in the water stoppage startup map illustrated in FIG. 10A, the water stoppage injection amount may be set such that the fourth injection amount difference Δm1 (Δm1=Q1*m*1−Q2*m*1) becomes larger than the fifth injection amount difference Δn1 (Δn1=Q1*n*1−Q2*n*1). It is also possible to set the water stoppage injection amount such that the fourth injection amount difference Δm1 is smaller than the fifth injection amount difference Δn1 in the water stoppage startup map. With such a configuration, the difference between the water stoppage injection amount and the water flow injection amount can be changed at the third predetermined period R3.

In the first embodiment, the startup fuel injection amount is set such that the difference between the water stoppage injection amount and the water flow injection amount when the elapsed time is long at the second predetermined period R2 is larger than the difference in a case where the elapsed time is short, but it is not limited to this configuration. For example, in the water stoppage startup map, the startup fuel injection amount may be set such that the difference between the water stoppage injection amount and the water flow injection amount when the elapsed time is long at the second predetermined period R2 is smaller than the difference when the elapsed time is short. Further, in the water stoppage startup map, the startup fuel injection amount may be set such that the difference between the water stoppage injection amount and the water flow injection amount is made constant regardless of the elapsed time at the second predetermined period R2.

In the first embodiment, the difference between the startup fuel injection amount in a case where the water stoppage control is being executed and the startup fuel injection amount in a case where the water stoppage control is not being executed is set to be larger in the second predetermined period R2 than in the first predetermined period R1, but the present disclosure is not limited to this configuration. For example, the difference between the startup fuel injection amount in a case where the water stoppage control is being executed and the startup fuel injection amount in a case where the water stoppage control is not being executed may be set to be smaller in the second predetermined period R2 than in the first predetermined period R1, or may be the same in the first predetermined period R1 and the second predetermined period R2.

In the second embodiment, the water stoppage fuel injection amount is calculated by multiplying the startup fuel injection amount calculated using the startup map by the correction value, which is a fixed value, but the correction value is not limited to the fixed value. For example, the correction value for the startup fuel injection amount at the second predetermined period R2 may be set to a value larger than the correction value for the startup fuel injection amount at the first predetermined period R1. In this case, under the condition that the water stoppage cooling water temperature and the water flow cooling water temperature are the same cooling water temperature and the water stoppage elapsed time and the water flow elapsed time are the same elapsed time, the difference between the water stoppage injection amount and the water flow injection amount becomes larger at the second predetermined period R2 than at the first predetermined period R1. Therefore, it is possible to obtain the same operational effects as the above (3).

The correction for the startup fuel injection amount at the second predetermined period R2 may be set such that the correction value when the elapsed time is long is increased as compared to the correction value when the elapsed time is short. In this case, the difference between the water stoppage injection amount and the water flow injection amount when the elapsed time is long at the second predetermined period R2 is larger than the difference when the elapsed time is short. Therefore, it is possible to obtain the same operational effects as the above (4).

In each embodiment, the determination as to whether the water stoppage control is being executed is made based on whether the water stoppage control is being executed by the adjusting valve controlling section 140, but it is not limited to this method. For example, based on determination as to whether the cooling water temperature determining section 139 determines that the cooling water temperature calculated by the cooling water temperature calculating section 138 is within the water stoppage execution temperature range, the water stoppage control execution determining section 141 may determine whether the water stoppage control is being executed.

In each embodiment, the detection timing of the cooling water temperature used for calculating the startup fuel injection amount may be timing other than the timing at which the automatic startup condition is satisfied. For example, the startup fuel injection amount may be calculated by using the cooling water temperature detected at the timing when the automatic stop condition is satisfied or at the timing when fuel injection from the fuel injection valve is stopped for automatic stop.

In each of the embodiments, the control device for the internal combustion engine in which the fuel injection valve is provided in the combustion chamber of the internal combustion engine and fuel is directly injected into the combustion chamber has been specifically described. However, the configuration of the present disclosure may be applied to a control device for an internal combustion engine in which a fuel injection valve is provided in the intake port. The intake port is disposed at a position close to the heat source of the internal combustion engine. Therefore, the port wall temperature, which is the wall temperature of the intake port, indicates the same change as the above-mentioned bore wall temperature. That is, the degree of decrease in the port wall temperature in a case where the water stoppage control is being executed when the internal combustion engine is automatically stopped is larger than the degree of decrease in the port wall temperature in a case where the water stoppage control is not being executed when the internal combustion engine is automatically stopped. Therefore, even in the case of calculating the startup fuel injection amount based on the cooling water temperature and the elapsed time in this configuration, by setting the startup fuel injection amount in the same manner as in each embodiment, it is possible to obtain the same operational effect as that of (1) or the like.

In each of the embodiments, the startup fuel injection amount is calculated based on the cooling water temperature and the elapsed time. However, the startup fuel injection amount may be calculated based on other parameters correlated with the bore wall temperature or the port wall temperature. Also in this case, the startup fuel injection amount in a case where the water stoppage control is being executed when the internal combustion engine is automatically stopped may be made larger than the startup fuel injection amount in a case where the water stoppage control is not being executed when the internal combustion engine is automatically stopped.

The cooling liquid in the cooling water passage 10 of the internal combustion engine may be a cooling liquid containing liquid other than water as a main component.

The invention claimed is:

1. A control device for an internal combustion engine, the internal combustion engine including an engine body, a water jacket provided in the engine body and constituting a passage of cooling liquid for cooling the engine body, a cooling liquid pump, which supplies the cooling liquid to the water jacket, and an adjusting valve, which adjusts a flow rate of the cooling liquid discharged from the water jacket, wherein the control device is configured to execute a water stoppage control for increasing a temperature of the engine body by limiting discharge of the cooling liquid from the water jacket by the adjusting valve, an automatic stop and automatic startup control for automatically stopping the internal combustion engine when an automatic stop condition is satisfied, and for automatically starting the internal combustion engine when an automatic startup condition is satisfied, and a control for increasing a fuel injection amount for automatically starting the internal combustion engine in a case where the water stoppage control is being executed when the internal combustion engine is automatically stopped as compared with a case where the water stoppage control is not being executed when the internal combustion engine is automatically stopped, under a condition that a cooling water temperature for calculating the fuel injection amount for the automatic startup in the case where the water stoppage control is being executed when the internal combustion engine is automatically stopped is the same as a cooling water temperature for calculating the fuel injection amount for the automatic startup in the case where the water stoppage control is not being executed when the internal combustion engine is automatically stopped.

2. The control device for an internal combustion engine according to claim 1, wherein the control device is configured to calculate a fuel injection amount for the automatic startup based on the cooling water temperature and elapsed time from the automatic stop, and the control device is configured to increase the fuel injection amount for the automatic startup in the case where the water stoppage control is being executed when the internal combustion engine is automatically stopped as compared to the case where the water stoppage control is not being executed when the internal combustion engine is automatically stopped under a condition that the elapsed time for calculating the fuel injection amount for the automatic startup in the case where the water stoppage control is being executed when the internal combustion engine is automatically stopped is the same as the elapsed time for calculating the fuel injection amount for the automatic startup in the case where the water stoppage control is not being executed when the internal combustion engine is automatically stopped.

3. The control device for an internal combustion engine according to claim 2, wherein the control device is configured such that a difference between the fuel injection amount for the automatic startup in the case where the water stoppage control is being executed when the internal combustion engine is automatically stopped and the fuel injection amount for the automatic startup in the case where the water stoppage control is not being executed when the internal combustion engine is automatically stopped is larger at a second predetermined period from an elapse of a first predetermined period to an elapse of a second predetermined time than at the first predetermined period from the automatic stop of the internal combustion engine to an elapse of the first predetermined time, under the condition that the cooling water temperature for calculating the fuel injection amount for the automatic startup in the case where the water stoppage control is being executed when the internal combustion engine is automatically stopped is the same as the cooling water temperature for calculating the fuel injection amount for the automatic startup in the case where the water stoppage control is not being executed when the internal combustion engine is automatically stopped and that the elapsed time for calculating the fuel injection amount for the automatic startup in the case where the water stoppage control is being executed when the internal combustion engine is automatically stopped is the same as the elapsed time for calculating the fuel injection amount for the automatic startup in the case where the water stoppage control is not being executed when the internal combustion engine is automatically stopped.

4. The control device for an internal combustion engine according to claim 3, wherein the control device is configured to make the difference when the elapsed time is long larger than the difference when the elapsed time is short at the second predetermined period.

5. The control device for an internal combustion engine according to claim 3, wherein the control device is configured to make the difference constant at a third predetermined period from an elapse of the second predetermined period to an elapse of a third predetermined time.

6. A control device for an internal combustion engine, the internal combustion engine including an engine body, a water jacket provided in the engine body and constituting a passage of cooling liquid for cooling the engine body, a cooling liquid pump, which supplies the cooling liquid to the water jacket, and an adjusting valve, which adjusts a flow rate of the cooling liquid discharged from the water jacket, wherein the control device includes circuitry configured to execute a water stoppage control for increasing a temperature of the engine body by limiting discharge of the cooling liquid from the water jacket by the adjusting valve, an automatic stop and automatic startup control for automatically stopping the internal combustion engine when an automatic stop condition is satisfied, and for automatically starting the internal combustion engine when an automatic startup condition is satisfied, and a control for increasing a fuel injection amount for automatically starting the internal combustion engine in a case where the water stoppage control is being executed when the internal combustion engine is automatically stopped as compared with a case where the water stoppage control is not being executed when the internal combustion engine is automatically stopped, under a condition that a cooling water temperature for calculating the fuel injection amount for the automatic startup in the case where the water stoppage control is being executed when the internal combustion engine is automatically stopped is the same as a cooling water temperature for calculating the fuel injection amount for the automatic startup in the case where the water stoppage control is not being executed when the internal combustion engine is automatically stopped.

7. A method for controlling an internal combustion engine, the internal combustion engine including an engine body, a water jacket provided in the engine body and constituting a passage of cooling liquid for cooling the engine body, a cooling liquid pump, which supplies the cooling liquid to the water jacket, and an adjusting valve, which adjusts a flow rate of the cooling liquid discharged from the water jacket, the control method comprising:

increasing a temperature of the engine body by limiting discharge of the cooling liquid from the water jacket by the adjusting valve;

automatically stopping the internal combustion engine when an automatic stop condition is satisfied, and automatically starting the internal combustion engine when an automatic startup condition is satisfied, and increasing a fuel injection amount for automatically starting the internal combustion engine in a case where the water stoppage control is being executed when the internal combustion engine is automatically stopped as compared with a case where the water stoppage control is not being executed when the internal combustion engine is automatically stopped, under a condition that a cooling water temperature for calculating the fuel injection amount for the automatic startup in the case where the water stoppage control is being executed when the internal combustion engine is automatically stopped is the same as a cooling water temperature for calculating the fuel injection amount for the automatic startup in the case where the water stoppage control is not being executed when the internal combustion engine is automatically stopped.

* * * * *